US010882039B2

(12) United States Patent
Schwemmer et al.

(10) Patent No.: US 10,882,039 B2
(45) Date of Patent: Jan. 5, 2021

(54) FLUIDIC MODULE, DEVICE AND METHOD FOR ALIQUOTING A LIQUID

(71) Applicants: Hahn-Schickard-Gesellschaft fuer angewandte Forschung e.V., Villingen-Schwenningen (DE); Albert-Ludwigs-Universitaet Freiburg, Freiburg (DE)

(72) Inventors: Frank Schwemmer, Freiburg (DE); Steffen Zehnle, Freiburg (DE); Nils Paust, Freiburg (DE); Pierre Dominique Kosse, Freiburg (DE); Daniel Mark, Freiburg (DE)

(73) Assignees: Hahn-Schickard-Gesellschaft fuer angewandte Forschung e.V., Villingen-Schwenningen (DE); Albert-Ludwigs-Universitaet Freiburg, Freiburg (DE)

( * ) Notice: Subject to any disclaimer, the term of this patent is extended or adjusted under 35 U.S.C. 154(b) by 0 days.

(21) Appl. No.: 15/089,317

(22) Filed: Apr. 1, 2016

(65) Prior Publication Data

US 2016/0214104 A1 Jul. 28, 2016

Related U.S. Application Data

(63) Continuation of application No. PCT/EP2014/070018, filed on Sep. 19, 2014.

(30) Foreign Application Priority Data

Oct. 1, 2013 (DE) ..... 10 2013 219 929

(51) Int. Cl.
*B01L 3/00* (2006.01)

(52) U.S. Cl.
CPC ..... *B01L 3/50273* (2013.01); *B01L 3/502715* (2013.01); *B01L 3/502746* (2013.01);
(Continued)

(58) Field of Classification Search
CPC ..... B01L 2300/0803; B01L 2300/0864; B01L 2300/087; B01L 2400/0409;
(Continued)

(56) References Cited

U.S. PATENT DOCUMENTS 5,409,665 A 4/1995 Burd et al.
6,632,399 B1 10/2003 Lin et al.
(Continued)

FOREIGN PATENT DOCUMENTS

CN 101073003 A 11/2007
CN 101455949 A 6/2009
(Continued)

OTHER PUBLICATIONS

Godino, et al., "Lab on a Chip: Comprehensive Integration of Homogeneous Bioassays via Centrifugo-Pneumatic Cascading", RSC Publishing, Journal: The Royal Society of Chemistry, 2013, Nov. 2012, pp. 685-694.
(Continued)

*Primary Examiner* — Samuel P Siefke
(74) *Attorney, Agent, or Firm* — Michael A. Glenn; Perkins Coie LLP

(57) ABSTRACT

A fluidic module includes first and second measuring chambers, first and second fluid inlet channels connected to the first and second measuring chambers, respectively, and first and second fluid outlet channels connected to the first and second measuring chambers, respectively. Upon rotation of the fluidic module about a center of rotation, liquids are centrifugally driven into the first and second measuring chambers via the first and second fluid inlet channels,
(Continued)

respectively, so that compressible media previously present within the first and second measuring chambers are compressed by the liquids driven into the first and second measuring chambers, respectively. Upon a reduction of the rotational frequency and upon an expansion, resulting therefrom, of the compressible media, the liquids present within the first and second measuring chambers are driven out of same via the first and second fluid outlet channels, respectively.

22 Claims, 13 Drawing Sheets

(52) U.S. Cl.
CPC ..... *B01L 2200/0605* (2013.01); *B01L 2200/0621* (2013.01); *B01L 2300/06* (2013.01); *B01L 2300/0803* (2013.01); *B01L 2300/087* (2013.01); *B01L 2300/0864* (2013.01); *B01L 2300/0867* (2013.01); *B01L 2400/0409* (2013.01); *B01L 2400/0481* (2013.01); *B01L 2400/0487* (2013.01); *B01L 2400/084* (2013.01)

(58) Field of Classification Search
CPC ..... B01L 3/50273; B01L 3/502738; B01L 2200/0621; B01L 2200/0652; B01L 2400/0677; B01L 3/502761; G01N 33/57492
See application file for complete search history.

(56) References Cited

U.S. PATENT DOCUMENTS

| | | | |
|---|---|---|---|
| 2009/0155925 | A1 | 6/2009 | Boehm |
| 2009/0246082 | A1 | 10/2009 | Saiki et al. |
| 2014/0356129 | A1 | 12/2014 | Paust et al. |

FOREIGN PATENT DOCUMENTS

| | | | |
|---|---|---|---|
| DE | 102008003979 | B3 | 6/2009 |
| DE | 102009050979 | A1 | 5/2011 |
| DE | 202011108189 | U1 | 2/2012 |
| DE | 102011083920 | A1 | 4/2013 |
| DE | 102012202775 | A1 | 8/2013 |
| DE | 102013203293 | A1 | 8/2014 |
| DE | 102013218978 | B3 | 11/2014 |
| EP | 1832872 | A1 | 9/2007 |
| EP | 2420319 | A1 | 2/2012 |
| JP | 2008083017 | A | 4/2008 |
| JP | 2010025645 | A | 2/2010 |
| WO | 2004113871 | A2 | 12/2004 |
| WO | 2006062149 | A1 | 6/2006 |
| WO | 2013124258 | A1 | 8/2013 |

OTHER PUBLICATIONS

Gorkin, Robert et al., "Pneumatic Pumping in Centrifugal Microfluidic Platforms", Microfluidics and Nanofluidics, Springer, Berlin, DE, bd.9, Nr. 2-3, Feb. 17, 2010, pp. 541-549.

Zahra, Noroozi et al., "A Multiplexed Immunoassay System Based Upon Reciprocating Centrifugal Microfluidics", Review of Scientific Instruments, AIP, Melville, NY, US, Bd. 82, Nr. 6, 21, Jun. 21, 2011, pp. 64303-64303.

Zehnle, S. et al., "Lab on a Chip: Centrifugo-Dynamic Inward Pumping of Liquids on a Centrifugal Micrfluidic Platform", Lab Chip,Dynamic Article Links, Journal: The Royal Society of Chemistry 2012, Oct. 5, 2012, pp. 5142-5145.

FLUIDIC MODULE, DEVICE AND METHOD FOR ALIQUOTING A LIQUID

CROSS-REFERENCE TO RELATED APPLICATIONS

This application is a continuation of copending International Application No. PCT/EP2014/070018, filed Sep. 19, 2014, which claims priority from German Application No. 10 2013 219 929.5, filed Oct. 1, 2013, which are each incorporated herein in its entirety by this reference thereto.

BACKGROUND OF THE INVENTION

The present invention relates to a fluidic module, a device for aliquoting a liquid and a method of aliquoting a liquid. Embodiments relate to parallel-pneumatic metering and aliquoting.

In centrifugal microfluidics, rotors are used for processing liquids. Corresponding rotors contain chambers for collecting liquid and channels for directing fluid. While the rotor is being subjected to centripetal acceleration, the liquid is pressed radially outward and can thus arrive at a radially outward position by directing fluid correspondingly. Centrifugal microfluidics is employed, for example, in the field of life sciences, in particular in laboratory analytics. Centrifugal microfluidics serves to automate process flows while replacing operations such as pipetting, mixing, metering, aliquoting and centrifuging.

Aliquoting of liquids may be performed in particular at the beginning, during or at the end of a process chain so as to perform several mutually independent detection reactions (verification reactions) with one sample. For parallelizing laboratory processes within a centrifugal-microfluidic rotor in a fully automated manner, aliquoting processes are therefore indispensable. In this context, certain analysis methods involve not only aliquoting of an individual liquid volume into several aliquots, but also aliquoting of several different liquid volumes, the aliquots of which in turn need to be further processed—e.g., mixed with one another. Quantitatively meaningful analysis processes can be performed only if the aliquots comprise volumes defined as accurately as possible. For this reason, each aliquoting step should also be combined with a metering step. This also applies in case different aliquoting steps take place in parallel within a centrifugal-microfluidic rotor.

Godino et al. [Lab Chip, 2013, 13, 685-69, FIG. 1] describes a metering structure containing a single compression chamber comprising an inlet channel and an outlet channel. The compression chamber consists of two sections extending radially outward (on the left and on the right) and a section extending radially inward. In this context, a defined partial volume can be collected by the left-hand section. Any excess liquid volume exceeding the volume of the left-hand section does not remain within the left-hand section and therefore cannot be separated off either.

However, one possibility of aliquoting defined amounts of liquid is not shown. Moreover, the metering structure taken from Godino et al. is workable only for liquid volumes that have strict upper limits since the overflow structure is contained within the compression chamber. Metering will therefore only work when the overflow chamber is not full. Moreover, said structure allows no aliquoting, as was already mentioned. In addition, the metering structure contains very broad inflow channels, as a result of which the metered volume will highly depend on the input volume.

What is also known is utilizing a compression chamber in combination with fluid channels exhibiting different hydraulic resistances. For example, Zehnle et al. (Lab Chip, 2012, 12, 5142-5145, FIG. 2) shows pumping of liquid within a centrifuge rotor from a radially outward point to a radially inward point without using any external auxiliary devices. However, the fluid structure described there enables neither metering nor aliquoting.

U.S. Pat. No. 5,409,665 describes how end cavities within a centrifugal-microfluidic rotor can be filled, via a supply channel extending radially outward, with ends extending radially inward. In this context, the end cavities are vented, so that air can escape from the end cavities during the filling process. Subsequently, the supernatant liquid above the end cavities is discharged via the supply channel and a siphon.

DE 10 2008 003 979 B3 describes how metering channels within a centrifugal-microfluidic rotor can be filled via a supply channel extending radially inward. The ends of the metering channels have end cavities located thereat. Since the end cavities are not vented, the air which flows from the metering channels into the end cavities while the metering channels are being filled cannot escape and is compressed. While the corresponding pneumatic pressure counteracts the centrifugal pressure of the liquid within the metering channels, the supernatant present will be discharged in the supply channel. By subsequently increasing the rotary frequency of the rotor, the liquid/gas interface between the liquid contained within the metering channels and the air contained within the end cavities becomes unstable, so that the compressed gas will escape from the end cavity through the liquid phase within the metering channel, and so that said liquid phase can be transferred to the end cavity.

In U.S. Pat. No. 5,409,665 and DE 102008003979 B3, aliquots are generated within end cavities. Further fluidic processing of the aliquots is not possible, however.

SUMMARY

According to an embodiment, a fluidic module may have: a first measuring chamber and a second measuring chamber; a first fluid inlet channel connected to the first measuring chamber and a second fluid inlet channel connected to the second measuring chamber; and a first fluid outlet channel connected to the first measuring chamber and a second fluid outlet channel connected to the second measuring chamber; the fluidic module being configured such that upon rotation of the fluidic module, a liquid is centrifugally driven into the first measuring chamber via the first fluid inlet channel and into the second measuring chamber via the second fluid inlet channel so that a compressible medium previously present within the first measuring chamber and within the second measuring chamber is compressed by the liquid driven into the first measuring chamber and into the second measuring chamber; the fluidic module being configured such that upon a reduction of the rotational frequency and upon an expansion, resulting therefrom, of the compressible medium, the liquid present within the first measuring chamber is driven out of the first measuring chamber via the first fluid outlet channel, and the liquid present within the second measuring chamber is driven out of the second measuring chamber via the second fluid outlet channel; the fluidic module having a fluid manifold, the first fluid inlet channel and the second fluid inlet channel being connected to the fluid manifold.

According to another embodiment, a device for aliquoting a liquid may have: a fluidic module, which may have: a first measuring chamber and a second measuring chamber; a first fluid inlet channel connected to the first measuring chamber and a second fluid inlet channel connected to the second measuring chamber; and a first fluid outlet channel connected to the first measuring chamber and a second fluid outlet channel connected to the second measuring chamber; the fluidic module being configured such that upon rotation of the fluidic module, a liquid is centrifugally driven into the first measuring chamber via the first fluid inlet channel and into the second measuring chamber via the second fluid inlet channel so that a compressible medium previously present within the first measuring chamber and within the second measuring chamber is compressed by the liquid driven into the first measuring chamber and into the second measuring chamber; the fluidic module being configured such that upon a reduction of the rotational frequency and upon an expansion, resulting therefrom, of the compressible medium, the liquid present within the first measuring chamber is driven out of the first measuring chamber via the first fluid outlet channel, and the liquid present within the second measuring chamber is driven out of the second measuring chamber via the second fluid outlet channel; the fluidic module having a fluid manifold, the first fluid inlet channel and the second fluid inlet channel being connected to the fluid manifold; and a drive; the drive being configured to subject, in a first phase, the fluidic module to such a rotational frequency that liquid is centrifugally driven into the first measuring chamber via the first fluid inlet channel and into the second measuring chamber via the second fluid inlet channel, so that a compressible medium previously present within the first measuring chamber and within the second measuring chamber is compressed by the liquid driven into the first measuring chamber and into the second measuring chamber; and the drive being configured to reduce, in a second phase, the rotational frequency to which the fluidic module is subjected to such an extent that due to the reduction of the rotational frequency and to the expansion, resulting therefrom, of the compressible medium, the liquid present within the first measuring chamber is driven out of the first measuring chamber via the first fluid outlet channel, and the liquid present within the second measuring chamber is driven out of the second measuring chamber via the second fluid outlet channel.

According to another embodiment, a method of aliquoting a liquid by means of a fluidic module, which fluidic module may have: a first measuring chamber and a second measuring chamber; a first fluid inlet channel connected to the first measuring chamber and a second fluid inlet channel connected to the second measuring chamber; and a first fluid outlet channel connected to the first measuring chamber and a second fluid outlet channel connected to the second measuring chamber; the fluidic module being configured such that upon rotation of the fluidic module, a liquid is centrifugally driven into the first measuring chamber via the first fluid inlet channel and into the second measuring chamber via the second fluid inlet channel so that a compressible medium previously present within the first measuring chamber and within the second measuring chamber is compressed by the liquid driven into the first measuring chamber and into the second measuring chamber; the fluidic module being configured such that upon a reduction of the rotational frequency and upon an expansion, resulting therefrom, of the compressible medium, the liquid present within the first measuring chamber is driven out of the first measuring chamber via the first fluid outlet channel, and the liquid present within the second measuring chamber is driven out of the second measuring chamber via the second fluid outlet channel; the fluidic module having a fluid manifold, the first fluid inlet channel and the second fluid inlet channel being connected to the fluid manifold, may have the steps of: subjecting the fluidic module to a rotational frequency, so that a liquid is centrifugally driven into the first measuring chamber via the first fluid inlet channel and into the second measuring chamber via the second fluid inlet channel so that a compressible medium previously present within the first measuring chamber and within the second measuring chamber is compressed by the liquid driven into the first measuring chamber and into the second measuring chamber; and reducing the rotational frequency to which the fluidic module is subjected, so that due to the reduction of the rotational frequency and to the expansion, resulting therefrom, of the compressible medium, the liquid present within the first measuring chamber is driven out of the first measuring chamber via the first fluid outlet channel, and the liquid present within the second measuring chamber is driven out of the second measuring chamber via the second fluid outlet channel.

Embodiments of the present invention provide a fluidic module comprising a first measuring chamber, a second measuring chamber, a first fluid inlet channel connected to the first measuring chamber and a second fluid inlet channel connected to the second measuring chamber, a first fluid outlet channel connected to the first measuring chamber and a second fluid outlet channel connected to the second measuring chamber. The fluidic module is configured such that upon rotation of the fluidic module about a center of rotation, a liquid is centrifugally driven into the first measuring chamber via the first fluid inlet channel and into the second measuring chamber via the second fluid inlet channel so that a compressible medium previously present within the first measuring chamber and within the second measuring chamber is compressed by the liquid driven into the first measuring chamber and into the second measuring chamber. The fluidic module is further configured such that upon a reduction of the rotational frequency and upon an expansion, resulting therefrom, of the compressible medium, a large part of the liquid present within the first measuring chamber is driven out of the first measuring chamber via the first fluid outlet channel, and a large part of the liquid present within the second measuring chamber is driven out of the second measuring chamber via the second fluid outlet channel.

Further embodiments provide a device for aliquoting a liquid. The device comprises the above-described fluidic module and a drive. The drive is configured configured to subject, in a first phase, the fluidic module to such a rotational frequency that liquid is centrifugally driven into the first measuring chamber via the first fluid inlet channel and into the second measuring chamber via the second fluid inlet channel, so that a compressible medium previously present within the first measuring chamber and within the second measuring chamber is compressed by the liquid driven into the first measuring chamber and into the second measuring chamber. The drive is further configured to reduce, in a second phase, the rotational frequency to which the fluidic module is subjected to such an extent that due to the reduction of the rotational frequency and to the expansion, resulting therefrom, of the compressible medium, a large part of the liquid present within the first measuring chamber is driven out of the first measuring chamber via the first fluid outlet channel, and a large part of the liquid present within the second measuring chamber is driven out of the second measuring chamber via the second fluid outlet channel.

Further embodiments provide a method of aliquoting a liquid by means of the above-described fluidic module. The method includes subjecting the fluidic module to such a rotational frequency that a liquid is centrifugally driven into the first measuring chamber via the first fluid inlet channel and into the second measuring chamber via the second fluid inlet channel so that a compressible medium previously present within the first measuring chamber and within the second measuring chamber is compressed by the liquid driven into the first measuring chamber and into the second measuring chamber. The method further includes reducing the rotational frequency to which the fluidic module is subjected, so that due to the reduction of the rotational frequency and to the expansion, resulting therefrom, of the compressible medium, a large part of the liquid present within the first measuring chamber is driven out of the first measuring chamber via the first fluid outlet channel, and a large part of the liquid present within the second measuring chamber is driven out of the second measuring chamber via the second fluid outlet channel.

Further embodiments of the present invention provide a fluidic module. The fluidic module comprises a measuring chamber, a compression chamber connected to the measuring chamber via a fluid overflow, a fluid inlet channel connected to the measuring chamber, and a fluid outlet channel connected to the measuring chamber. The fluidic module is configured such that upon a rotation of the fluidic module about a center of rotation, a liquid is centrifugally driven into the measuring chamber via the fluid inlet channel until liquid gets into the compression chamber from the measuring chamber via the fluid overflow and until a compression, caused by the liquid driven into the measuring chamber, of a compressible medium previously present within the measuring chamber, within the compression chamber and within the fluid overflow is sufficiently large so that upon a reduction of a rotational frequency and upon an expansion, resulting therefrom, of the compressible medium, a large part of the liquid present within the measuring chamber is driven out of the measuring chamber via the fluid outlet channel. Moreover, the fluidic module is configured such that upon a reduction of the rotational frequency and upon an expansion, resulting therefrom, of the compressible medium, a large part of the liquid present within the measuring chamber is driven out of the measuring chamber via the fluid outlet channel.

In embodiments, the fluidic module may be configured such that upon a rotation of the fluidic module about a center of rotation, the liquid is driven into the measuring chamber via the fluid inlet channel by a centrifugal pressure caused by the rotation and acting upon the liquid, until liquid from the measuring chamber gets into the compression chamber via the fluid overflow and until a counter pressure resulting from a compression, caused by the liquid driven into the measuring chamber, of a compressible medium previously present within the measuring chamber, within the compression chamber and within the fluid overflow becomes sufficiently large so that upon a reduction of a rotational frequency and upon a reduction, resulting therefrom, of the centrifugal pressure, the compressible medium expands and drives a large part of the liquid present within the measuring chamber out of the measuring chamber via the fluid outlet channel. Moreover, the fluidic module may be configured such that upon the reduction of the rotational frequency and the reduction, caused thereby, of the centrifugal pressure, the compressible medium expands and drives a large part of the liquid present within the measuring chamber out of the measuring chamber via the fluid outlet channel.

Further embodiments provide a device for aliquoting a liquid. The device comprises the above-described fluidic module and a drive. The drive is configured to subject, in a first phase, the fluidic module to such a rotational frequency that the liquid is centrifugally driven into the measuring chamber via the fluid inlet channel until liquid from the measuring chamber gets into the compression chamber via the fluid overflow and until a compression, caused by the liquid driven into the measuring chamber, of a compressible medium previously present within the measuring chamber, within the compression chamber and within the fluid overflow becomes sufficiently large so that upon a reduction of the rotational frequency and upon an expansion, resulting therefrom, of the compressible medium, a large part of the liquid present within the measuring chamber is driven out of the measuring chamber via the fluid outlet channel. Moreover, the drive is configured to reduce, in a second phase, the rotational frequency to which the fluidic module is subjected in such a manner that a large part of the liquid present within the measuring chamber is driven out of the measuring chamber via the outlet channel by the expansion of the compressible medium, which expansion results from the reduction of the rotational frequency.

Further embodiments provide a method of aliquoting a liquid by means of the above-described fluidic module. The method includes subjecting the fluidic module to such a rotational frequency that the liquid is centrifugally driven into the measuring chamber via the fluid inlet channel until liquid from the measuring chamber gets into the compression chamber via the fluid overflow and until a compression, caused by the liquid driven into the measuring chamber, of a compressible medium previously present within the measuring chamber, within the compression chamber and within the fluid overflow becomes sufficiently large so that upon a reduction of the rotational frequency and upon an expansion, resulting therefrom, of the compressible medium, a large part of the liquid present within the measuring chamber is driven out of the measuring chamber via the fluid outlet channel. Moreover, the method includes reducing the rotational frequency to which the fluidic module is subjected, so that a large part of the liquid present within the measuring chamber is driven out of the measuring chamber via the outlet channel by the expansion of the compressible medium, which expansion results from the reduction of the rotational frequency.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
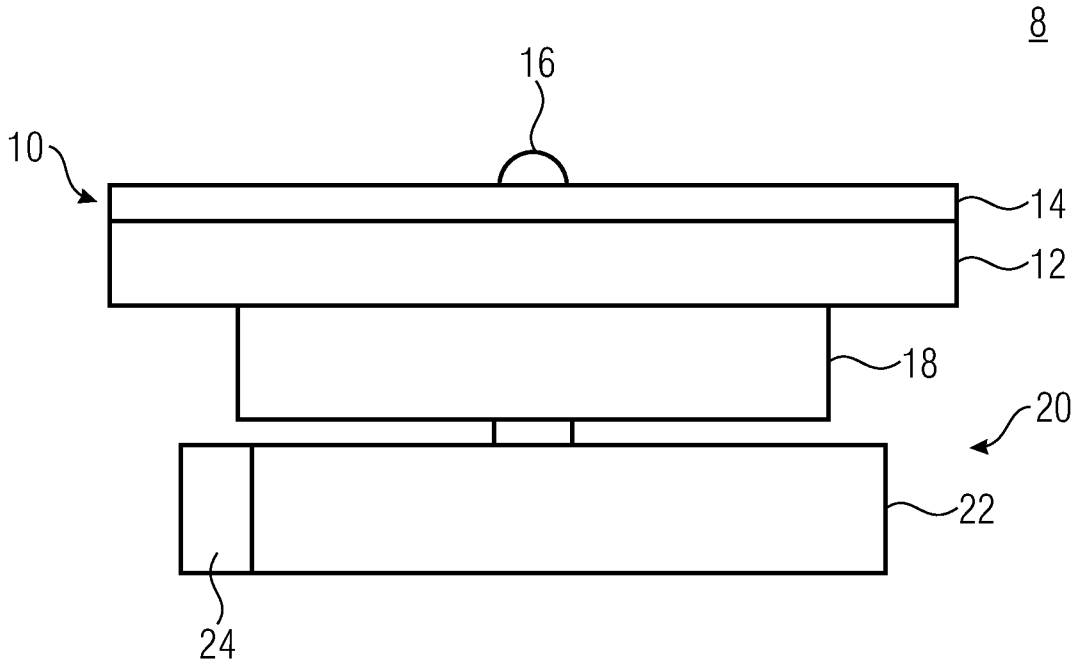
FIG. 1 shows a schematic side view for illustrating embodiments of the present invention.

In the subsequent description of the embodiments of the invention, elements which are identical or have identical actions will be provided with identical reference numerals in the figures, so that their descriptions in the various embodiments are mutually exchangeable.

Before embodiments of the invention will be explained in more detail, it shall initially be pointed out that embodiments of the present invention are employed, in particular, in the field of centrifugal microfluidics, which is about processing of liquids within the nanoliter to milliliter ranges. Accordingly, the fluidic structures may comprise suitable dimensions within the micrometer range for handling corresponding volumes of liquid. The fluidic structures (geometric structures) as well as the pertinent methods are suitable for metering and/or aliquoting liquid within centrifuge rotors.

When the expression radial is used herein, what is meant in each case is radial in relation to the center of rotation about which the fluidic module and/or the rotor is rotatable. Within the centrifugal field, therefore, a radial direction away from the center of rotation is radially falling, and a radial direction toward the center of rotation is radially rising. A fluid channel whose beginning is closer to the center of rotation than is its end, is thus radially falling, whereas a fluid channel whose beginning is further away from the center of rotation than is its end, is radially rising.

Before an embodiment of a fluidic module having corresponding fluidic structures will be addressed in more detail with reference to FIGS. 3 and 4, embodiments of an inventive device will be described first with reference to FIGS. 1 and 2.

FIG. 1 shows a device 8 comprising a fluidic module 10 in the form of a body of rotation comprising a substrate 12 and a cover 14. The substrate 12 and the cover 14 may be circular in a plan view and comprise a central opening via which the body of rotation 10 may be mounted to a rotating part 18 of a drive device via customary fastening means 16. The rotating part 18 is pivoted on a stationary part 22 of the drive device 20. The drive device may be a conventional centrifuge having an adjustable rotational speed or a CD or DVD drive, for example. Provision may be made of control means 24 configured to control the drive device 20 to subject the body of rotation 10 to rotations at different rotory frequencies. As is obvious to persons skilled in the art, the control means 24 may be implemented, for example, by a computing means programmed accordingly or by an application integrated circuit. The control means 24 may further be configured to control the drive device 20, upon manual inputs on the part of a user, to cause the useful rotations of the body of rotation. In any case, the control means 24 is configured to control the drive device 20 to subject the body of rotation to the rotary frequencies that may be used so as to implement the invention as described herein. As the drive device 20, a conventional centrifuge with only one direction of rotation may be used.

The body of rotation 10 comprises the fluidic structures that may be used. The fluidic structures that may be used may be formed by cavities and channels within the cover 14, the substrate 12 or within the substrate 12 and the cover 14. In embodiments, for example, fluidic structures may be formed within the substrate 12, whereas filler openings and venting openings are formed in the cover 14.

Figure 2:
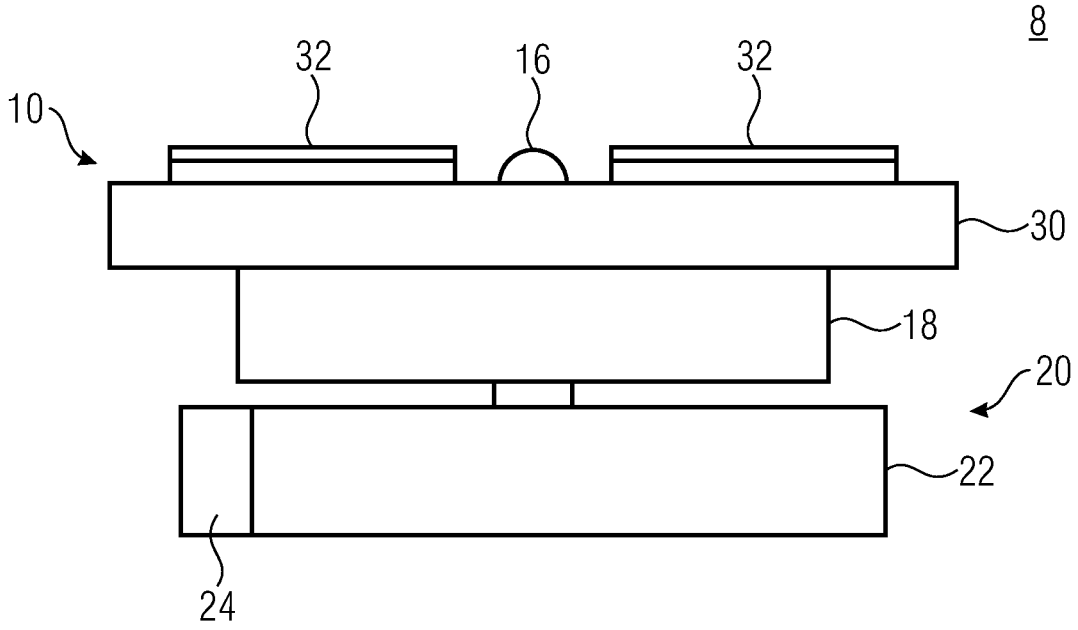
FIG. 2 shows a schematic side view for illustrating embodiments of the present invention.

In an alternative embodiment shown in FIG. 2, fluidic modules 32 are inserted into a rotor 30 and form, along with the rotor 30, the body of rotation 10. The fluidic modules 32 may each comprise a substrate and a cover wherein corresponding fluidic structures may be formed in turn. The body of rotation 10 formed by the rotor 30 and the fluidic modules 32 in turn can be subjected to rotation by a drive device 20 controlled by the control means 24.

In embodiments of the invention, the fluidic module and/or the body of rotation which comprises the fluidic structures may be formed of any suitable material, for example a plastic such as PMMA (polymethyl methacrylate, polycarbonate, PVC, polyvinylchloride) or PDMS (polydimethylsiloxane), glass or the like. The body of rotation 10 may be considered as being a centrifugal-microfluidic platform.

Figure 3A:
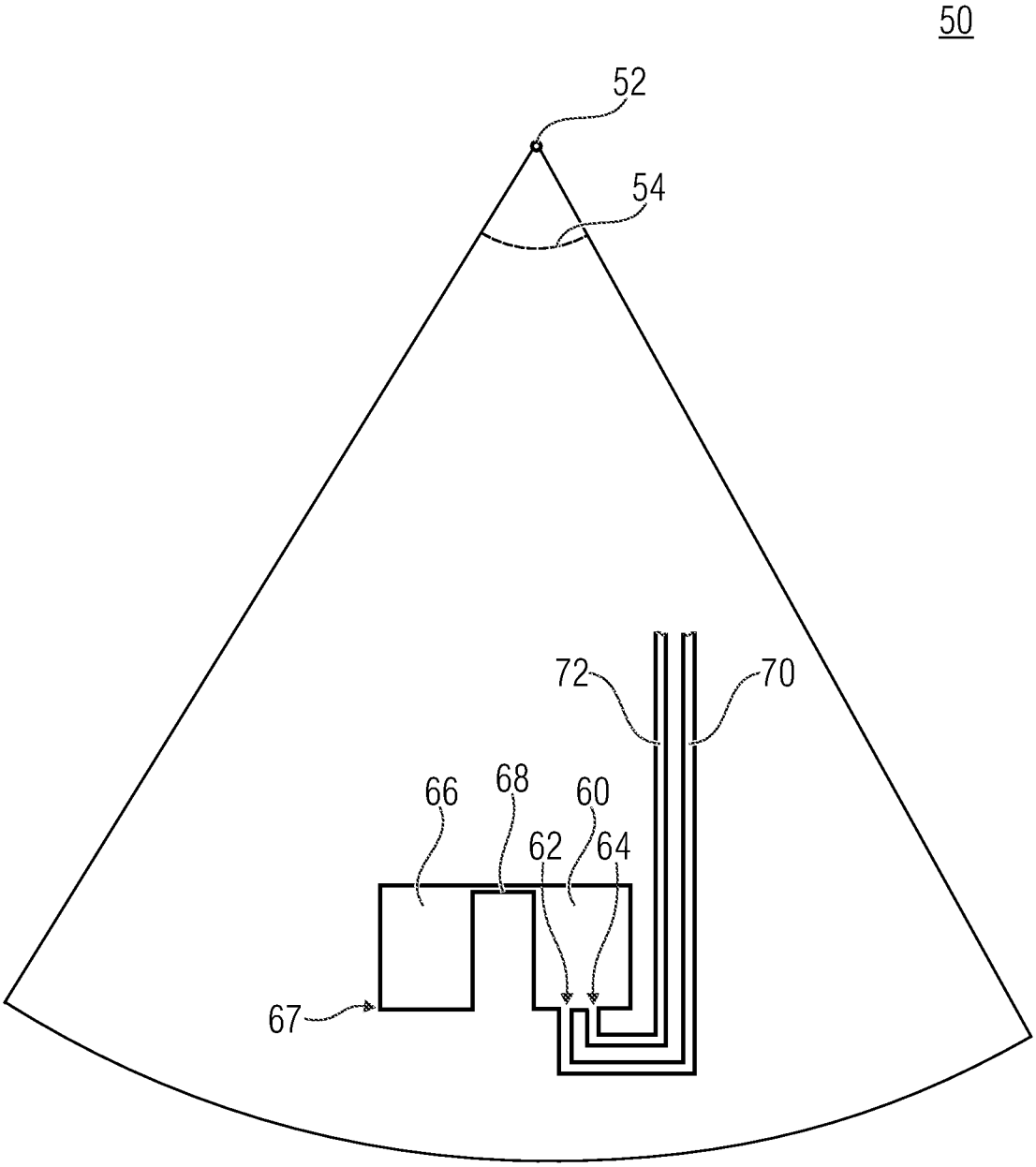
FIG. 3*a* shows a schematic top view of a detail of a fluidic module in accordance with an embodiment of the present invention.

FIG. 3*a* shows a top view of a detail of an inventive fluidic module 50 where a cover has been omitted so that the fluidic structures can be seen. The fluidic module 50 shown in FIG. 3*a* may have the shape of a disc, so that the fluidic structures are rotatable about a center of rotation 52. The disc may comprise a central hole 54 for being attached to a drive device, as was explained above for example with reference to FIGS. 1 and 2.

The fluidic structures of the fluidic module 50 may comprise a measuring chamber 60, a compression chamber 66 connected to the measuring chamber 60 via a fluid overflow 68, a fluid inlet channel 70 connected to the measuring chamber 60, and a fluid outlet channel 72 connected to the measuring chamber 60.

The fluidic module 50 may be configured such that upon a rotation of the fluidic module 50 about the center of rotation 52, a liquid is centrifugally driven into the measuring chamber 60 via the fluid inlet channel 70 until liquid from the measuring chamber 60 gets into the compression chamber 66 via the fluid overflow 68 and until a compression, caused by the liquid driven into the measuring chamber 60, of a compressible medium previously present within the measuring chamber 60, within the compression chamber 66 and within the fluid overflow 68 is sufficiently large so that upon a reduction of a rotational frequency and upon an expansion, resulting therefrom, of the compressible medium, a large part of the liquid present within the measuring chamber 60 is driven out of the measuring chamber 60 via the fluid outlet channel 72. In this context, the fluidic module 50 may be configured such that upon a reduction of the rotational frequency and upon the expansion, resulting therefrom, of the compressible medium, a large part of the liquid present within the measuring chamber 60 is driven out of the measuring chamber 60 via the fluid outlet channel 72.

In embodiments, the measuring chamber 60, the compression chamber 66 and the fluid overflow 68 may be configured such that upon the rotation of the fluidic module 50 about the center of rotation 52, the liquid is centrifugally driven into the measuring chamber 60 via the fluid inlet channel 70 until liquid from the measuring chamber 60 gets into a portion (e.g., collection area) 67 of the compression chamber 66 via the fluid overflow 68, in which portion the liquid which has got into the portion of the compression chamber 66 is fluidically separate from the liquid present within the measuring chamber 60.

To this end, the fluid overflow 68 may be arranged radially further inward than a radially outward end of the measuring chamber 60. For example, the fluid overflow 68 may be arranged, as can be seen in FIG. 3*a*, at a radially inward end of the measuring chamber 60 and/or of the compression chamber 66. In this case, the measuring chamber 60 is initially filled (completely) before liquid from the measuring chamber 60 gets to the portion 67 of the compression chamber 66 via the fluid overflow 68.

Moreover, a radially outward end of the compression chamber 66 may be arranged radially further outward than a radially outward end of the measuring chamber 60.

The fluidic module 50 may be configured such that upon the rotation of the fluidic module 50 about the center of rotation 52, the liquid centrifugally driven into the measuring chamber 60 encompasses the compressible medium present within the measuring chamber 60, the compression chamber 66 and the fluid overflow 68.

Prior to filling, i.e., before the liquid is centrifugally driven into the measuring chamber 60, the measuring chamber may also contain (dry or liquid) reagents in addition to the compressible medium. In other words, the measuring chamber 60 may also have (dry or liquid) reagents stored therein.

In embodiments, the measuring chamber 60 may comprise a fluid inlet 62 and a fluid outlet 64, the fluid inlet channel 70 being connected to the measuring chamber 60 via the fluid inlet 62 and the fluid outlet channel 72 being connected to the measuring chamber 60 via the fluid outlet 64. Of course, the measuring chamber 60 may also comprise a combined fluid inlet/fluid outlet 62,64, the fluid inlet channel 70 and the fluid outlet channel 72 being connected to the measuring chamber 60 via the combined fluid inlet/fluid outlet 62,64.

In this context, the fluid outlet 64 of the measuring chamber 60 may be arranged such that the fluid outlet 64 of the measuring chamber 60 is sealed off by the liquid centrifugally driven into the measuring chamber 60. For example, the fluid outlet 64 of the measuring chamber 60 may be arranged at a radially outward end of the measuring chamber 60 (bottom), as is shown in FIG. 3*a* in accordance with a possible embodiment.

In the embodiment shown in FIG. 3*a*, the fluid inlet 62 of the measuring chamber is also arranged at the radially outward end of the measuring chamber 60 (bottom). Of course, the fluid inlet 62 of the measuring chamber 60 may also be arranged at a different position, such as at a radially inward end of the measuring chamber 60 (top) or between the radially inward end of the measuring chamber 60 and the radially outward end of the measuring chamber 60.

The fluidic module 50 may further be configured such that upon the rotation of the fluidic module 50 about the center of rotation 52, the amount of liquid centrifugally driven into the measuring chamber 60 is larger than that which can be accommodated by the measuring chamber 60, so that fluid from the measuring chamber 60 gets into the compression chamber 66 via the fluid overflow 68.

For example, the fluid inlet channel 70 may be connected to an inlet area of the fluidic module 50. The inlet area of the fluidic module 50 may be configured such that the former can accommodate a larger volume of the liquid (liquid volume) than the measuring chamber 60.

Of course, the inlet area of the fluidic module 50 may also be configured such that a larger volume of liquid may be introduced into the inlet area of the fluidic module 50 than the measuring chamber 60 can accommodate. For example, the inlet area of the fluidic module 50 may be connected to a liquid chamber, so that prior to and/or upon the rotation of the fluidic module 50 about the center of rotation 52, liquid from the liquid chamber gets into the inlet area of the fluidic module 50. Moreover, the inlet area of the fluidic module 50 may be configured as a liquid reception or be connected to a liquid reception, so that prior to and/or upon the rotation of the fluidic module 50 about the center of rotation 52, liquid may be introduced into the liquid reception.

The measuring chamber 60 may be configured to meter a defined volume of the liquid (liquid volume). The measuring chamber 60 thus may be configured such that it may accommodate a defined and reproducible liquid volume which may subsequently be driven, e.g. via the fluid outlet channel 72, into a chamber connected to the fluid outlet channel 72.

The measuring chamber 60, the compression chamber 66 and the fluid overflow 68 may be configured such that liquid from the measuring chamber 60 does not get into the portion 67 of the compression chamber 66 via the fluid overflow 68 before the measuring chamber 60 has received the volume of the liquid that is to be metered (e.g., before the measuring chamber 60 has been (completely) filled). Any liquid that continues to be centrifugally driven into the measuring chamber 60 thus flows—once the measuring chamber 60 has received the volume of the liquid that is to be metered—from the measuring chamber 60 into the portion 67 of the compression chamber 66 via the fluid overflow 68, so that the filling level within the measuring chamber 60 will not change.

The volume of the liquid (liquid volume) metered by the measuring chamber 60 may be defined by a point of overflow located between the measuring chamber 60 and the compression chamber 66. The point of overflow may be defined, for example, by a mouth of the fluid overflow 68 that opens into the measuring chamber 60, or by a geometric shape of the fluid overflow 68. For example, the fluid overflow 68 may be configured such that same comprises at least one area (point of overflow) located between the measuring chamber 60 and the compression chamber which is arranged radially further inward (i.e., has a smaller distance from the center of rotation) than are the mouths of the fluid overflow 68 that open into the measuring chamber 60 and the compression chamber 66.

By means of the measuring chamber 60, a defined and reproducible liquid volume may thus be metered. Therefore, liquid may be aliquoted by means of the measuring chamber, or, in other words, at least an aliquot part (sub-portion) of the liquid may be metered and subsequently be driven, via the fluid outlet channel 72, into a chamber connected to the fluid outlet channel 72 by means of the expansion of the compressible medium.

However, it shall be pointed out that a quotient of the liquid volume metered by the measuring chamber 60 and of the volume of the liquid (to be metered and/or aliquoted) contained within the inlet area of the fluidic module 50 or introduced into the inlet area of the fluidic module 50 may be integer or non-integer.

So that upon the reduction of the rotational frequency and upon the expansion, resulting therefrom, of the compressible medium, the liquid present within the measuring chamber 60 is (at least largely or predominantly) driven out of the measuring chamber 60 via the fluid outlet channel 72, the fluidic module 50 may be configured such that a fluidic resistance of the fluid inlet channel 70 is larger than a fluidic resistance of the fluid outlet channel 72. Of course, the fluidic module 50 may also be configured such that a fluidic resistance of the fluid inlet 62 of the measuring chamber 60 is larger than a fluidic resistance of the fluid outlet 64 of the measuring chamber 60.

Moreover, the fluidic module 50 may be configured such that upon the reduction of the rotational frequency and upon the expansion, resulting therefrom, of the compressible medium, the liquid present within the measuring chamber 60 is (almost) completely driven out of the measuring chamber 60.

In this context it shall be noted that even following complete expansion of the compressible medium, a (negligible) portion of the liquid may remain, or linger, within the measuring chamber 60, so that the liquid is not completely, but almost completely driven out of the measuring chamber 60, e.g., in an amount of at least 90% (or 80%, 85%, 95%, 99%).

Moreover, it shall be noted that a (negligible) portion of the liquid may also be driven out of the measuring chamber 60 via the fluid inlet channel 70. In this context, the fluidic module 50 may be configured such that the liquid is largely, e.g., in an amount of at least 90% (or 80%, 85%, 95%, 99%), driven out of the measuring chamber 60 via the fluid outlet channel 72.

For example, the fluidic module 50 may be configured such that upon the reduction of the rotational frequency, the liquid that has got into the compression chamber 66 remains within the compression chamber 66, so that upon the reduction of the rotational frequency and upon the expansion, resulting therefrom, of the compressible medium, the liquid present within the measuring chamber 60 is (almost) completely driven out of the measuring chamber 60. The liquid remaining within the compression chamber 66 thus takes up a part of the volume of the compression chamber 66. Upon the reduction of the rotational frequency and upon the expansion, resulting therefrom, of the compressible medium, the compressible medium thus will have less volume within the compression chamber 66 available to it than it did before, whereby an excess volume fraction, resulting from the liquid remaining within the compression chamber 66, of the compressible medium exits the measuring chamber 60 via the fluid outlet channel 72 while being able to not only drive the liquid out of the measuring chamber 60 (almost) completely, but being able to (almost) completely drive the liquid, via the fluid outlet channel 72 (if a length of the fluid outlet channel 72 is dimensioned accordingly), into a chamber connected to the fluid outlet channel 72.

As can be seen in FIG. 3*a*, the fluid overflow 68 may be configured as a fluid overflow channel connecting the measuring chamber 60 and the compression chamber 66. The fluid overflow channel 68 may be arranged radially further inward than an outer end of the measuring chamber 60 and/or of the compression chamber 66, for example. For example, the fluid overflow channel 68 may be arranged at a radially inward end of the measuring chamber 60 and/or of the compression chamber 68. Of course, in some embodiments the overflow channel 68 may also be arranged at a radially outward end of the measuring chamber 60 and/or of the compression chamber 66.

Figure 3B:
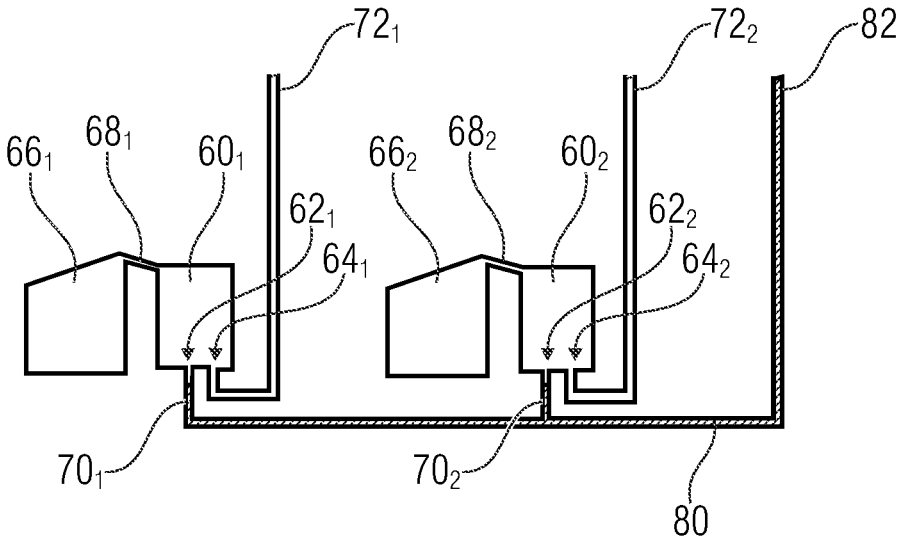
FIG. 3*b* shows a schematic top view of a detail of a fluidic module in accordance with an embodiment of the present invention.

FIG. 3*b* shows a schematic top view of a detail of a fluidic module 50 in accordance with an embodiment of the present invention.

As was already described with reference to FIG. 3*a*, the fluidic module 50 may comprise a (first) measuring chamber $\mathbf{60}_1$ having a fluid inlet and a fluid outlet, a (first) compression chamber $\mathbf{66}_1$ connected to the (first) measuring chamber $\mathbf{60}_1$ via a (first) fluid overflow $\mathbf{68}_1$, a (first) fluid inlet channel $\mathbf{70}_1$ connected to the fluid inlet of the (first) measuring chamber $\mathbf{60}_1$, and a (first) fluid outlet channel $\mathbf{72}_1$ connected to the fluid outlet of the (first) measuring chamber $\mathbf{60}_1$.

As can additionally be seen in FIG. 3*b*, the fluidic module 50 may comprise a second measuring chamber $\mathbf{60}_2$ having a fluid inlet and a fluid outlet, a second compression chamber $\mathbf{66}_2$ connected to the second measuring chamber $\mathbf{60}_2$ via a second fluid overflow $\mathbf{68}_2$, a second fluid inlet channel $\mathbf{70}_2$ connected to the fluid inlet of the second measuring chamber $\mathbf{60}_2$, and a second fluid outlet channel $\mathbf{72}_2$ connected to the fluid outlet of the second measuring chamber $\mathbf{60}_2$.

Generally, the fluidic module 50 may comprise at least one further measuring chamber $\mathbf{60}_2$ to $\mathbf{60}_n$ having a fluid inlet and a fluid outlet, at least a further compression chamber $\mathbf{66}_2$ to $\mathbf{66}_n$ connected to the at least one further measuring chamber $\mathbf{60}_2$ to $\mathbf{60}_n$ via at least one further fluid overflow $\mathbf{68}_2$ to $\mathbf{68}_n$, at least one further fluid inlet channel $\mathbf{70}_2$ to $\mathbf{70}_n$ connected to the fluid inlet of the at least one further measuring chamber $\mathbf{60}_2$ to $\mathbf{60}_n$, and at least one further fluid outlet channel $\mathbf{72}_2$ to $\mathbf{72}_n$ connected to the fluid outlet of the at least one further measuring chamber $\mathbf{60}_2$ to $\mathbf{60}_n$.

The fluidic module 50 shown in FIG. 3*b* comprises, by way of example, two measuring chambers $\mathbf{60}_1$ to $\mathbf{60}_n$ (n=2) with associated compression chambers $\mathbf{66}_1$ to $\mathbf{66}_n$ (n=2), fluid overflows $\mathbf{68}_1$ to $\mathbf{68}_n$ (n=2), fluid inlet channels $\mathbf{70}_1$ to $\mathbf{70}_n$ (n=2) and fluid outlet channels $\mathbf{72}_1$ to $\mathbf{72}_n$ (n=2). Of course, the fluidic module 50 may comprise up to n measuring chambers $\mathbf{60}_1$ to $\mathbf{60}_n$ with associated compression chambers $\mathbf{66}_1$ to $\mathbf{66}_n$, fluid overflows $\mathbf{68}_1$ to $\mathbf{68}_n$, fluid inlet channels $70_1$ to $70_n$ and fluid outlet channels $72_1$ to $72_n$, n being a natural number larger than or equal to 1, n≥1.

In accordance with the mode of operation already described with reference to FIG. 3*a*, the fluidic module 50 may be configured such that upon the rotation of the fluidic module 50 about the center of rotation 52, a liquid is centrifugally driven into the at least one further measuring chamber $60_2$ to $60_n$ (n=2) via the at least one further fluid inlet channel $70_2$ to $70_n$ (n=2) until liquid from the at least one further measuring chamber $60_2$ to $60_n$ (n=2) gets into the at least one further compression chamber $66_2$ to $66_n$ (n=2) via the at least one further fluid overflow $68_2$ to $68_n$ (n=2) and until a compression, caused by the liquid driven into the at least one further measuring chamber $60_2$ to $60_n$ (n=2), of a compressible medium previously present within the at least one further measuring chamber $60_2$ to $60_n$ (n=2), within the at least one further compression chamber $66_2$ to $66_n$ (n=2) and within the at least one further fluid overflow $68_2$ to $68_n$ (n=2) is sufficiently large so that upon the reduction of the rotational frequency and upon an expansion, resulting therefrom, of the compressible medium, the liquid present within the at least one further measuring chamber $60_2$ to $60_n$ (n=2) is driven out of the at least one further measuring chamber $60_2$ to $60_n$ (n=2) via the at least one further fluid outlet channel $72_2$ to $72_n$ (n=2). Moreover, the fluidic module 50 may be configured such that upon the reduction of the rotational frequency and upon the expansion, resulting therefrom, of the compressible medium, the liquid present within the at least one further measuring chamber $60_2$ to $60_n$ (n=2) is driven out of the at least one further measuring chamber $60_2$ to $60_n$ (n=2) via the at least one further fluid outlet channel $72_2$ to $72_n$ (n=2).

In embodiments, the fluidic module 50 may comprise a fluid manifold 80, the fluid inlet channel $70_1$ and the at least one further fluid inlet channel $70_2$ to $70_n$ (n=2) being connected to the fluid manifold 80. The fluid inlet channel $70_1$ and the at least one further fluid inlet channel $70_2$ to $70_n$ may comprise fluidic resistances higher than those of the fluid manifold $80_1$ to $80_2$.

For example, the fluid inlet channel $70_1$ and the at least one further fluid inlet channel $70_2$ to $70_n$ each may comprise a fluidic resistance that is higher by at least a factor of 5 (or 10, 15, 20 or more) than that of the fluid manifold 80.

Moreover, the fluidic module 50 may comprise a fluid inlet connected to the fluid manifold 80 via a fluid channel 82. The fluid channel 82 may comprise a fluidic resistance higher than that of the fluid manifold 80.

For example, the fluid channel 82 may have a fluidic resistance that is higher by at least a factor of 5 (or 10, 15, 20 or more) than that of the fluid manifold 80.

In other words, the filling channels (fluid inlet channels $70_1$ to $70_n$ and manifold 80) may be subdivided into areas having low and high fluidic resistances. In this manner, uniform filling of the measuring chambers (measuring cavities) $60_1$ to $60_n$ (n=2) as well as fluidic decoupling of the measuring chambers (measuring cavities) $60_1$ to $60_n$ (n=2) upon emptying by the fluid outlet channels $72_1$ to $72_n$ (n=2) can be ensured. By the areas having low fluidic resistances it may be ensured that the measuring chamber $60_n$ contains a volume similar to that of the measuring chamber $60_1$.

As can be seen in FIG. 3*b*, the fluid inlet channels $70_1$ to $70_n$ (n=2) may form inflows which connect the manifold (or auxiliary channel) 80 to the measuring chambers $60_1$ to $60_n$. The inflows $70_1$ to $70_n$ (n=2) may have a high fluidic resistance. The manifold (or auxiliary channel) 80, which connects the inflows $70_1$ to $70_n$ (n=2) of the measuring chambers $60_1$ to 60, (n=2) to the fluid channel (inlet channel) 82, may comprise a low fluidic resistance. The fluid channel (inlet channel) 82 may connect the filling channels to the fluidic inlet; the fluid channel (inlet channel) 82 may have a high fluidic resistance (not mandatorily a high resistance).

Figure 3C:
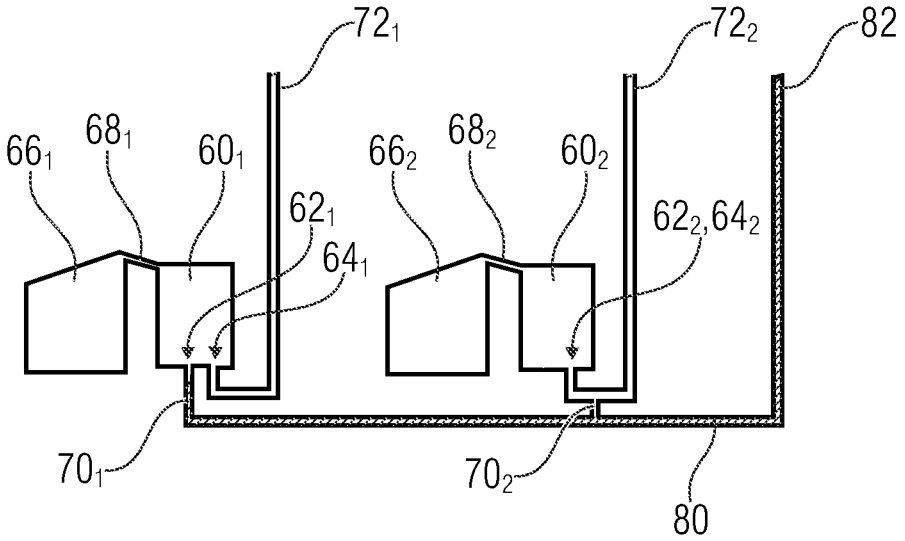
FIG. 3*c* shows a schematic top view of a detail of a fluidic module in accordance with an embodiment of the present invention.

FIG. 3*c* shows a schematic top view of a detail of a fluidic module 50 in accordance with an embodiment of the present invention.

As can be seen in FIG. 3*c*, the measuring chamber $60_1$ comprises a fluid inlet $62_1$ and a fluid outlet $64_1$, the fluid inlet channel $70_1$ being connected to the measuring chamber $60_1$ via the fluid inlet $62_1$, and the fluid outlet channel $72_1$ being connected to the measuring chamber $60_1$ via the fluid outlet $64_1$.

In contrast to this, the measuring chamber $60_2$ comprises a combined fluid inlet/fluid outlet $62_2$,$64_2$, the fluid inlet channel 70 and the fluid outlet channel 72 being connected to the measuring chamber $60_2$ via the combined fluid inlet/fluid outlet $62_2$,$64_2$.

In this context, the fluid inlet channel 70 and the fluid outlet channel 72 may be directly connected to the combined fluid inlet/fluid outlet 62,64, i.e., in each case directly open into the measuring chamber 60 via the combined fluid inlet/fluid outlet 62,64. Of course, the fluid inlet channel 70 and the fluid outlet channel 72 may also be joined upstream from the combined fluid inlet/fluid outlet 62,64.

For example, the fluid inlet channel 70 and the fluid outlet channel 72 may be joined by means of a fluid channel piece (e.g., T-piece or Y-piece), the fluid channel piece being directly connected to the combined fluid inlet/fluid outlet 62,64.

Moreover, the fluid inlet channel 70 may be directly connected to the combined fluid inlet/fluid outlet 62,64, while the fluid outlet channel 72 is connected to the combined fluid inlet/fluid outlet 62,64 via the fluid inlet channel 70, i.e., the fluid outlet channel 72 initially opens into the fluid inlet channel 70.

Furthermore, the fluid outlet channel 72 may be directly connected to the combined fluid inlet/fluid outlet 62,64, while the fluid inlet channel 70 is connected to the combined fluid inlet/fluid outlet 62,64 via the fluid outlet channel, i.e., the fluid inlet channel 70 initially opens into the fluid outlet channel 72.

Figure 3D:
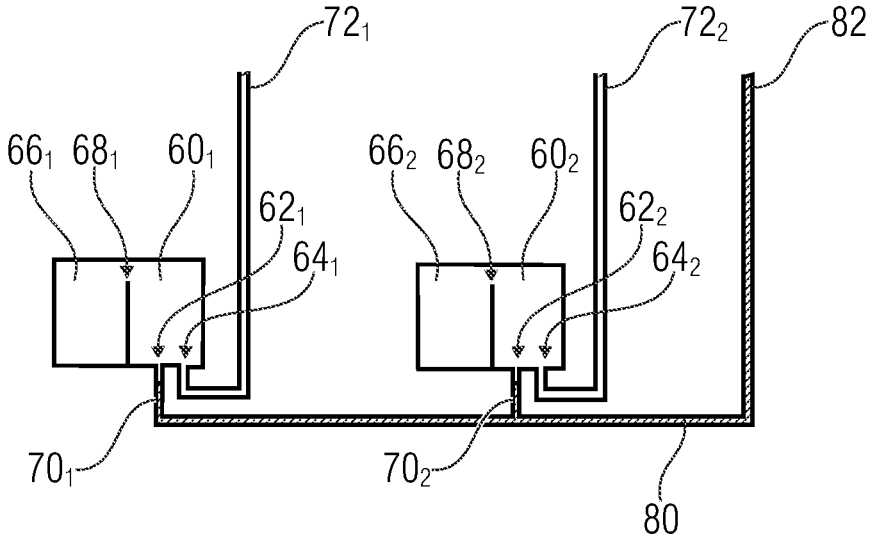
FIG. 3*d* shows a schematic top view of a detail of a fluidic module in accordance with an embodiment of the present invention.

FIG. 3*d* shows a schematic top view of a detail of a fluidic module 50 in accordance with an embodiment of the present invention. As can be seen in FIG. 3*d*, the measuring chambers $60_1$ to $60_n$ (n=2) and the compression chambers $66_1$ to $66_n$ (n=2) may be arranged immediately adjacent to one another; it is possible for the fluid overflows $68_1$ to $68_n$ (n=2) to be formed not only by channels (e.g., capillaries) as shown above, but also by discontinuous partition walls between measuring chambers $60_1$ to $60_n$ (n=2) and compression chambers $66_1$ to $66_n$ (n=2).

Figure 3E:
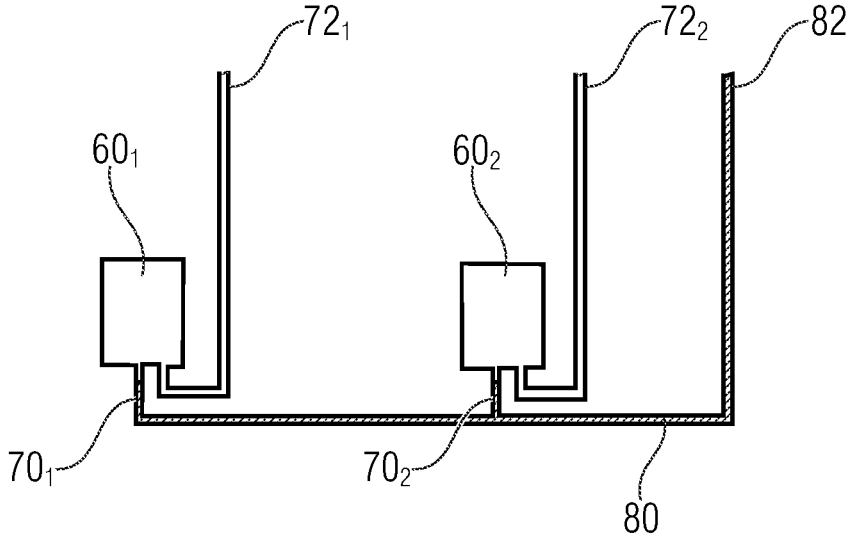
FIG. 3*e* shows a schematic top view of a detail of a fluidic module in accordance with an embodiment of the present invention.

FIG. 3*e* shows a schematic top view of a detail of a fluidic module 50 in accordance with an embodiment of the present invention. The fluidic module 50 may comprise a measuring chamber $60_1$, at least one further measuring chamber $60_2$ (n=2), a fluid inlet channel $70_1$ connected to the measuring chamber $60_1$, at least one further fluid inlet channel $70_2$ (n=2) connected to the at least one further measuring chamber $60_2$ (n=2), a fluid outlet channel $72_1$ connected to the measuring chamber $60_1$, and at least one further fluid outlet channel $72_2$ (n=2) connected to the at least one further measuring chamber $60_2$ (n=2).

The fluidic module 50 may be configured such that upon a rotation of the fluidic module 50 about the center of rotation 52, a liquid is centrifugally driven into the measuring chamber $60_1$ via the fluid inlet channel $70_1$ and into the at least one further measuring chamber $60_n$ (n=2) via the at least one further fluid inlet channel $70_n$ (n=2), so that a compressible medium previously present within the measuring chamber $60_1$ and within the at least one further measuring chamber $60_n$ (n=2) is compressed by the liquid driven into the measuring chamber $60_1$ and into the at least one further measuring chamber $60_n$ (n=2). The fluidic module 50 may further be configured such that upon a reduction of the rotational frequency and upon an expansion, resulting therefrom, of the compressible medium, a large part of the liquid present within the measuring chamber $60_1$ is driven out of the measuring chamber $60_1$ via the fluid outlet channel $72_1$ and a large part of the liquid present within the at least one further measuring chamber $60_n$ (n=2) is driven out of the at least one further measuring chamber $60_n$ (n=2) via the at least one further fluid outlet channel $72_n$ (n=2).

The mode of operation of the fluidic module 50 shown in FIG. 3*b* shall be explained in more detail below with reference to FIGS. 4*a* to 4*f*. FIGS. 4*a* to 4*f* each show a schematic top view of the fluidic module 50 shown in FIG. 3*b* as well as liquid levels within the fluidic module 50 at six different points in time. However, it shall be noted that the description which follows is also applicable to the fluidic modules 50 shown in FIGS. 3*a* and 3*b* to 3*e*.

The fluidic module 50 shown in FIGS. 4*a* to 4*f* may be used for aliquoting liquid. In this context, individual volumes (of the liquid to be aliquoted) may be metered under high centrifugation, and in this manner, a compressed compressible medium (e.g., compressed air) which has been compressed under centrifugation by the liquid to be metered may be separated and be directed onward within chambers connected to the fluid outlet channels (e.g., subsequent chambers).

To this end, liquid is transferred from an inlet area of the fluidic module 50 into different measuring chambers (measuring cavities or metering cavities) $60_1$ to $60_n$ (n=2) under centrifugation. Each measuring chamber $60_1$ to $60_n$ (n=2) is configured such that when being filled with liquid under centrifugation, a volume of a compressible medium (e.g., air volume) will be trapped and compressed. The liquid therefore can flow in for such time until a pneumatic counter-pressure equivalent to the centrifugal pressure has been built up. The measuring chamber $60_1$ to $60_n$ (n=2) may be configured such that normally, the amount of liquid flowing in is larger than that to be metered. Any excess liquid flows from the measuring chamber $60_1$ to $60_n$ (n=2) via a point of overflow and remains within the compression chamber $66_1$ to $66_n$ (n=2), which forms a separate collection area.

Different output volumes generate different counter-pressures due to different levels of compression of the compressible medium (e.g., air). This results in that the filling levels within the fluid inlet channels (filling channels) $70_1$ to $70_n$ (n=2) and the fluid outlet channels (channels to subsequent cavities) $72_1$ to $72_n$ (n=2) depend on the input volume. In order to achieve as high a level of measurement accuracy as possible it is therefore useful to generate as small interfaces 76 as possible in fluid inlet channels $70_1$ to $70_n$ (n=2) and fluid outlet channels $72_1$ to $72_n$ (n=2) that are narrowed accordingly (see FIG. 4*c*). Ideally, the diameters of the fluid inlet channels $70_1$ to $70_n$ (n=2) and of the fluid outlet channels $72_1$ to $72_n$ (n=2) should be smaller by at least a factor of five than dimensions (e.g., diameter or diagonal) of the measuring chamber $60_1$ to $60_n$ (n=2).

If the rotational frequency (or centrifugation speed) is reduced, the centrifugal pressure will decrease. Due to the lower pressure, the compressed volume of the compressible medium (e.g., air volume) expands, and the metered liquid is forwarded from the measuring chambers $60_1$ to $60_n$ (n=2) into subsequent chambers via channels $70_1$ to $70_n$ (n=2). The aliquots thus forwarded will then be defined in terms of their volumes and can be used for further processes.

Since liquid will remain within the compression chamber (collection area) $66_1$ to $66_n$ (n=2), the volume of liquid that is pumped on during this metering process is smaller than that of compressible medium (e.g., air) which has been compressed. Moreover, the geometric configuration of the measuring chamber $60_1$ to $60_n$ (n=2) and of the fluid inlet channels (filling channels) $70_1$ to $70_n$ (n=2) 70 may be selected such that the compressible medium (e.g., air) escapes advantageously through the fluid outlet channel $72_1$ to $72_n$ (n=2). Consequently, the measuring chamber $60_1$ to $60_n$ (n=2) may thus be completely emptied even if the fluid outlet channel $72_1$ to $72_n$ (n=2) points radially inward.

Thus, the interplay with any further aliquoting structure results in the possibility of aliquoting several liquids into split end cavities in parallel without involving several fluidic layers. In known aliquoting principles, this is possible only to a very limited extent because of channel crossings.

When manufacturing a physical fluid structure, the various channels for forwarding will not be exactly identical. As a result, the fluidic resistances of the fluid inlet channels $70_1$ to $70_n$ (n=2) and of the fluid outlet channels $72_1$ to $72_n$ (n=2) will vary, and there will be inaccuracies regarding emptying. To minimize said inaccuracies it is useful to reduce or even minimize fluidic communication between the measuring chambers $60_1$ to $60_n$ (n=2). This may be effected, for example, in that the fluid inlet channel (filling channel) $70_1$ to $70_n$ (n=2) has a fluidic resistance substantially higher than that of the fluid outlet channels $72_1$ to $72_n$ (n=2) for forwarding the liquid/directing the liquid onward.

In the following, the mode of operation of the fluidic module 50 shall be described in more detail with reference to FIGS. 4*a* to 4*f*, which show the liquid levels within the fluidic module 50 at six different points in time.

Figure 4A:
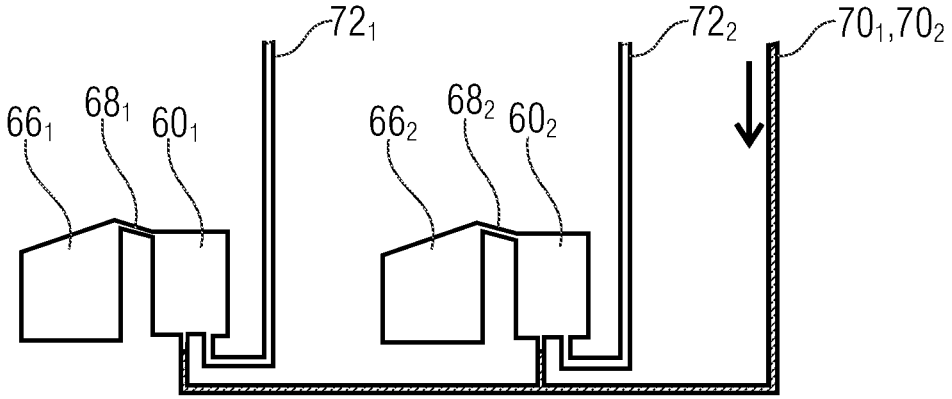
FIG. 4*a* shows a schematic top view of a detail of a fluidic module and a liquid level within the fluidic module at a first point in time, in accordance with an embodiment of the present invention.
Figure 4B:
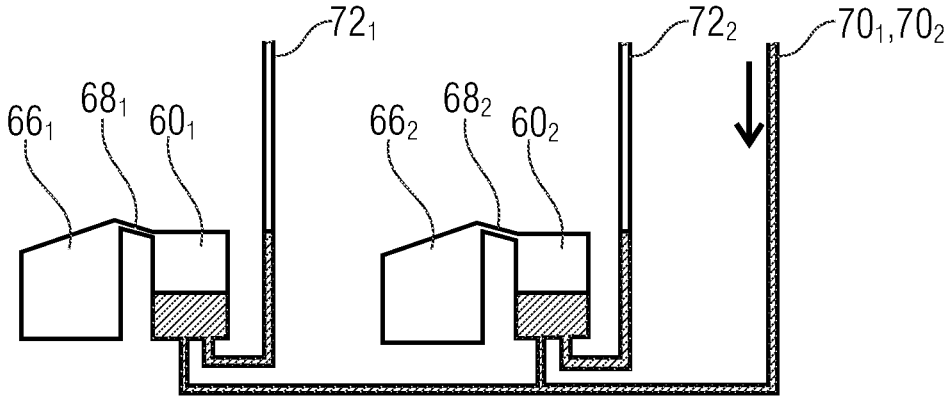
FIG. 4*b* shows a schematic top view of the detail of the fluidic module and a liquid level within the fluidic module at a second point in time, in accordance with an embodiment of the present invention.
Figure 4C:
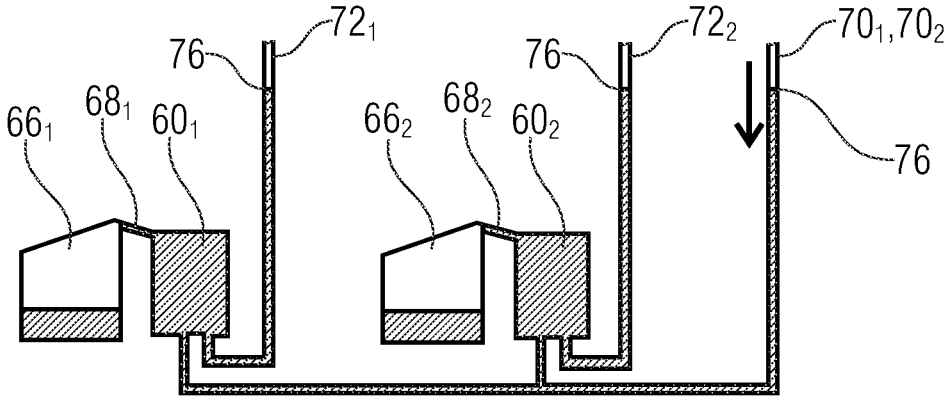
FIG. 4*c* shows a schematic top view of the detail of the fluidic module and a liquid level within the fluidic module at a third point in time, in accordance with an embodiment of the present invention.
Figure 4D:
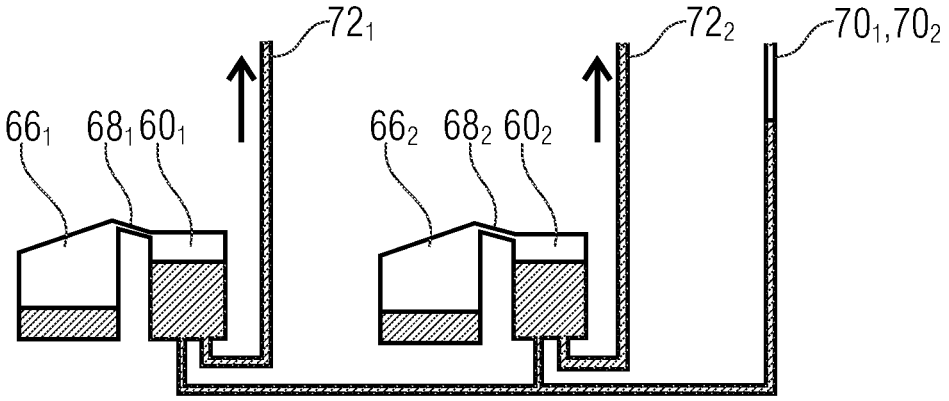
FIG. 4*d* shows a schematic top view of the detail of the fluidic module and a liquid level within the fluidic module at a fourth point in time, in accordance with an embodiment of the present invention.
Figure 4E:
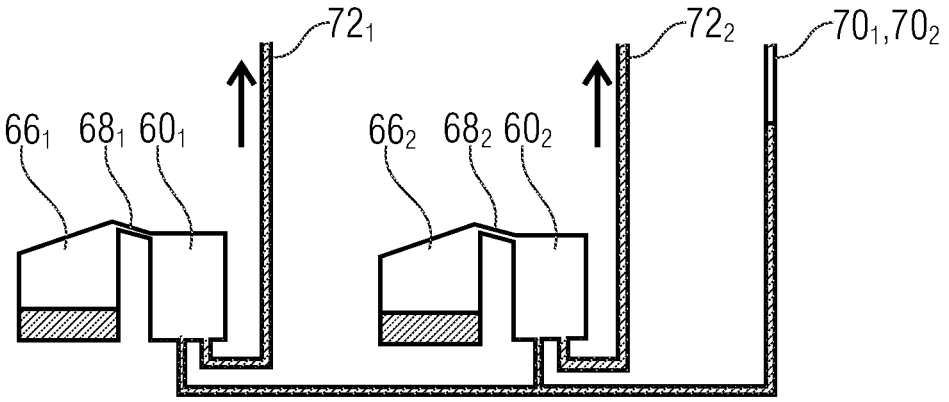
FIG. 4*e* shows a schematic top view of the detail of the fluidic module and a liquid level within the fluidic module at a fifth point in time, in accordance with an embodiment of the present invention.
Figure 4F:
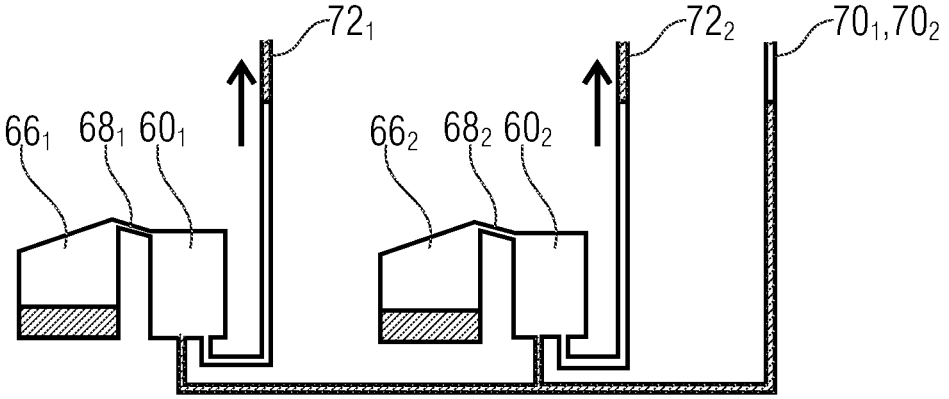
FIG. 4*f* shows a schematic top view of the detail of the fluidic module and a liquid level within the fluidic module at a sixth point in time, in accordance with an embodiment of the present invention.

The fluidic module 50 shall be subjected, for example by the drive 20 described with reference to FIGS. 1 and 2, to a first rotational frequency $f_1$ in a first phase (FIGS. 4*a* to 4*c*), while the fluidic module 50 is subjected to a second rotational frequency $f_2$ in a second phase (FIGS. 4*d* to 4*f*). The second rotational frequency $f_2$ is smaller than the first rotational frequency $f_1$, $f_1>f_2$.

FIG. 4*a* shows a schematic top view of the fluidic module 50 and a liquid level within the fluidic module 50 at a first point in time. At the first point in time, the fluidic module 50 is subjected to the first rotational frequency $f_1$, whereby the liquid present, e.g., within an inlet area of the fluidic module 50 or is introduced into the inlet area of the fluidic module 50 is centrifugally driven toward the measuring chambers $60_1$ to $60_n$ (n=2) via the fluid inlet channels $70_1$ to $70_n$ (n=2) connected, e.g., to the inlet area of the fluidic module 50, which results in the liquid level shown in FIG. 4*a*.

FIG. 4*b* shows a schematic top view of the fluidic module 50 and a liquid level within the fluidic module 50 at a second point in time. At the second point in time, the fluidic module 50 continues to be subjected to the first rotational frequency $f_1$, whereby the liquid is centrifugally driven into the measuring chambers $60_1$ to $60_n$ (n=2) via the fluid inlet channels $70_1$ to $70_n$ (n=2), so that the liquid level within the measuring chambers $60_1$ to $60_n$ (n=2) has risen as compared to the liquid level shown in FIG. 4*a*.

In this process, as can be seen in FIG. 4*b*, the compressible medium previously present within the measuring chambers $60_1$ to $60_n$ (n=2), within the fluid overflows $68_1$ to $68_n$ (n=2) and within the compression chambers $62_1$ to $62_n$ (n=2)

is trapped and compressed by the liquid centrifugally driven into the measuring chambers $60_1$ to $60_n$ (n=2), whereby a pressure of the compressible medium rises. In other words, a volume that is available to the compressible medium is reduced by the liquid volume centrifugally driven into the measuring chambers $60_1$ to $60_n$ (n=2), as a result of which the pressure of the compressible medium rises.

FIG. 4*c* shows a schematic top view of the fluidic module 50 and a liquid level within the fluidic module 50 at a third point in time. At the third point in time, the fluidic module 50 continues to be subjected to the first rotational frequency $f_1$, whereby the liquid continues to be centrifugally driven into the measuring chambers $60_1$ to $60_n$ (n=2) via the fluid inlet channels $70_1$ to $70_n$, so that by the third point in time, the liquid level within the measuring chambers $60_1$ to $60_n$ (n=2) has risen up to the point of overflow and liquid from the measuring chambers $60_1$ to $60_n$ has got into the compression chambers $66_1$ to $66_n$ (n=2) (n=2) via the fluid overflows $68_1$ to $68_n$ (n=2).

As compared to FIG. 4*b*, in FIG. 4*c* the volume available to the compressible medium was further reduced by the liquid volume centrifugally driven into the measuring chambers $60_1$ to $60_n$ (n=2) and now extends only to part of the compression chambers $66_1$ to $66_n$ (n=2), which, with regard to FIG. 4*b*, results in a further increase in the pressure of the compressible medium.

FIG. 4*d* shows a schematic top view of the fluidic module 50 and a liquid level within the fluidic module 50 at a fourth point in time. Between the third and the fourth points in time, the rotational frequency to which the fluidic module 50 is subjected has been reduced from the first rotational frequency $f_1$ to the second rotational frequency $f_2$, which results in an expansion of the compressible medium, whereby the liquid present within the measuring chambers $60_1$ to $60_n$ (n=2) is driven out of the measuring chambers $60_1$ to $60_n$ (n=2) via the fluid outlet channels $72_1$ to $72_n$ (n=2), while the liquid that previously got into the compression chambers $66_1$ to $66_n$ (n=2) remains within the compression chambers $66_1$ to $66_n$ (n=2).

FIG. 4*e* shows a schematic top view of the fluidic module 50 and a liquid level within the fluidic module 50 at a fifth point in time. At the fifth point in time, the fluidic module 50 continues to be subjected to the second rotational frequency $f_2$, whereby the compressible medium expands further, so that the liquid present within the measuring chambers $60_1$ to $60_n$ (n=2) is (almost) completely driven out of the measuring chambers $60_1$ to $60_n$ (n=2) via the fluid outlet channels $72_1$ to $72_n$ (n=2).

FIG. 4*f* shows a schematic top view of the fluidic module 50 and a liquid level present within the fluidic module 50 at a sixth point in time. At the sixth point in time, the fluidic module 50 continues to be subjected to the second rotational frequency $f_2$. Due to the liquid remaining within the compression chambers $66_1$ to $66_n$ (n=2), the compressible medium expands further, so that the liquid cannot only be (almost) completely driven out of the measuring chambers $60_1$ to $60_n$ (n=2) via the fluid outlet channels $72_1$ to $72_n$ (n=2) but may even be (almost) completely driven into downstream chambers connected with the fluid outlet channels $72_1$ to $72_n$ (n=2) (provided that a length of the fluid outlet channels $72_1$ to $72_n$ (n=2) is configured accordingly).

In other words, due to the liquid volume remaining within the compression chambers $66_1$ to $66_n$ (n=2), the liquid volume metered within the measuring chambers $60_1$ to $60_n$ (n=2) may be (almost) completely driven, due to the expansion of the compressible medium, into downstream chambers connected to the fluid outlet channels $72_1$ to $72_n$ (n=2).

Thus, the fluidic module 50 as shown in FIGS. 4*a* to 4*f* can be filled under centrifugation (see FIG. 4*a*). Once a first liquid volume has flowed into the measuring chambers $60_1$ to $60_n$ (n=2), the hermetically entrapped volume V of the compressible medium (e.g., air volume) will be compressed (see FIG. 4*b*). Any excess liquid flows from the measuring chambers $60_1$ to $60_n$ (n=2) into the compression chambers (e.g., collection cavity) $66_1$ to $66_n$ (n=2) via the fluid overflows $68_1$ to $68_n$ (n=2) (see FIG. 4*c*). While the rotational frequency (rotational speed) is reduced, the compressible medium (e.g., entrapped air) relaxes, and the liquid is forwarded into subsequent chambers through the fluid outlet channels $72_1$ to $72_n$ (n=2) (see FIGS. 4*d* and 4*e*). Due to the liquid remaining within the compression chambers $66_1$ to $66_n$ (n=2), there will still be excess pressure within the compression chambers $66_1$ to $66_n$ (n=2) even at the fifth point in time. This results in that even the liquid volume remaining within the fluid outlet channels $72_1$ to $72_n$ (n=2) can be transported into subsequent chambers (or cavities).

Figure 5:
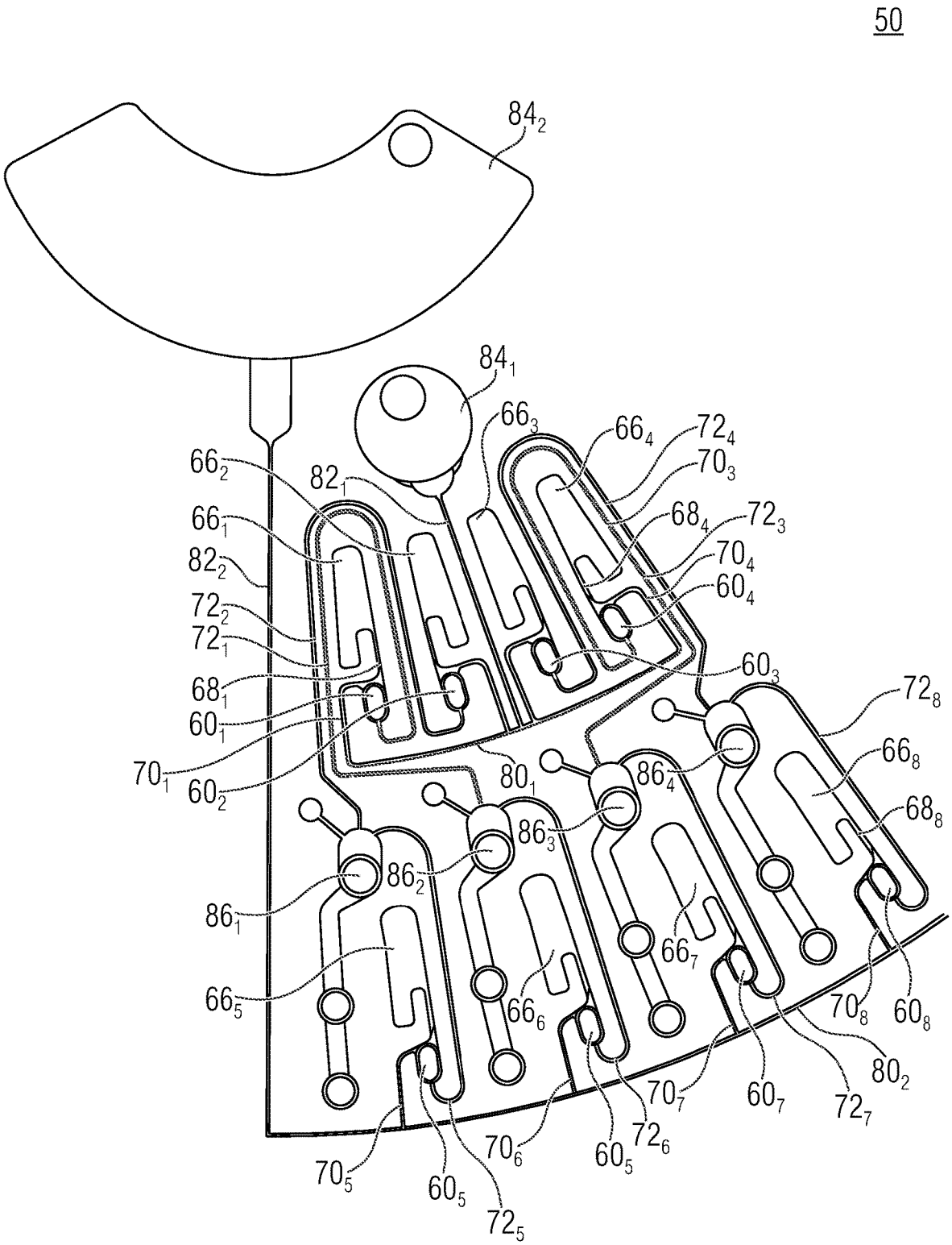
FIG. 5 shows a schematic top view of a detail of a fluidic module in accordance with an embodiment of the present invention.

FIG. 5 shows a schematic top view of a detail of a fluidic module 100 in accordance with an embodiment of the present invention. The fluidic module 50 shown in FIG. 5 comprises eight measuring chambers $60_1$ to $60_n$ (n=8) with associated compression chambers $66_1$ to $66_n$ (n=8), fluid overflows $68_1$ to 68, (n=8), fluid inlet channels $70_1$ to 70, (n=8) and fluid outlet channels $72_1$ to $72_n$ (n=8).

The eight measuring chambers $60_1$ to 60, (n=8) are subdivided into a first half of measuring chambers $60_1$ to $60_4$ and a second half of measuring chambers $60_5$ to $60_8$, the first half of measuring chambers $60_1$ to $60_4$ being arranged radially further inward than the second half of measuring chambers $60_5$ to $60_8$.

The fluid inlet channels $70_1$ to $70_4$ of the first half of measuring chambers $60_1$ to $60_4$ are connected to a first inlet area $84_1$ of the fluidic module 50 via a first manifold $80_1$ and a first radially extending channel $82_1$, while the fluid inlet channels $70_5$ to $70_8$ of the second half of measuring chambers $60_5$ to $60_8$ are connected to a second inlet area $84_2$ of the fluidic module 50 via a second manifold $80_2$ and a second radially extending channel $82_2$.

The fluid outlet channels $70_1$ to $70_4$ of the first half of measuring chambers $60_1$ to $60_4$ and the fluid outlet channels $70_5$ to $70_8$ of the second half of measuring chambers $60_5$ to $60_8$ are connected in pairs, respectively, to a (downstream) chamber $86_1$ to $86_4$.

In detail, the first fluid outlet channel $72_1$ and the fifth fluid outlet channel $72_5$ are connected to the first (downstream) chamber $86_1$, while the second fluid outlet channel $72_2$ and the sixth fluid outlet channel $72_6$ are connected to the second (downstream) chamber $86_2$, while the third fluid outlet channel $72_3$ and the seventh fluid outlet channel $72_7$ are connected to the third (downstream) chamber $86_3$ and while the fourth fluid outlet channel $72_4$ and the eighth fluid outlet channel $72_8$ are connected to the fourth (downstream) chamber $86_4$.

For example, the fluidic module 50 may be used for mixing liquids in that a first liquid is introduced into the first inlet area $84_1$ and a second liquid is introduced into the second inlet area $84_2$, so that upon the reduction of the rotational frequency and the associated expansion of the compressible medium into the (downstream) chambers $86_1$ to $86_4$, an aliquot of the first liquid and a aliquot of the second liquid are centrifugally driven, respectively.

In the following, the mode of operation of the fluidic module 50 shown in FIG. 5 will be explained in more detail by means of FIGS. 6*a* to 6*e*, which show liquid levels within the fluidic module 50 at five different points in time.

Figure 6A:
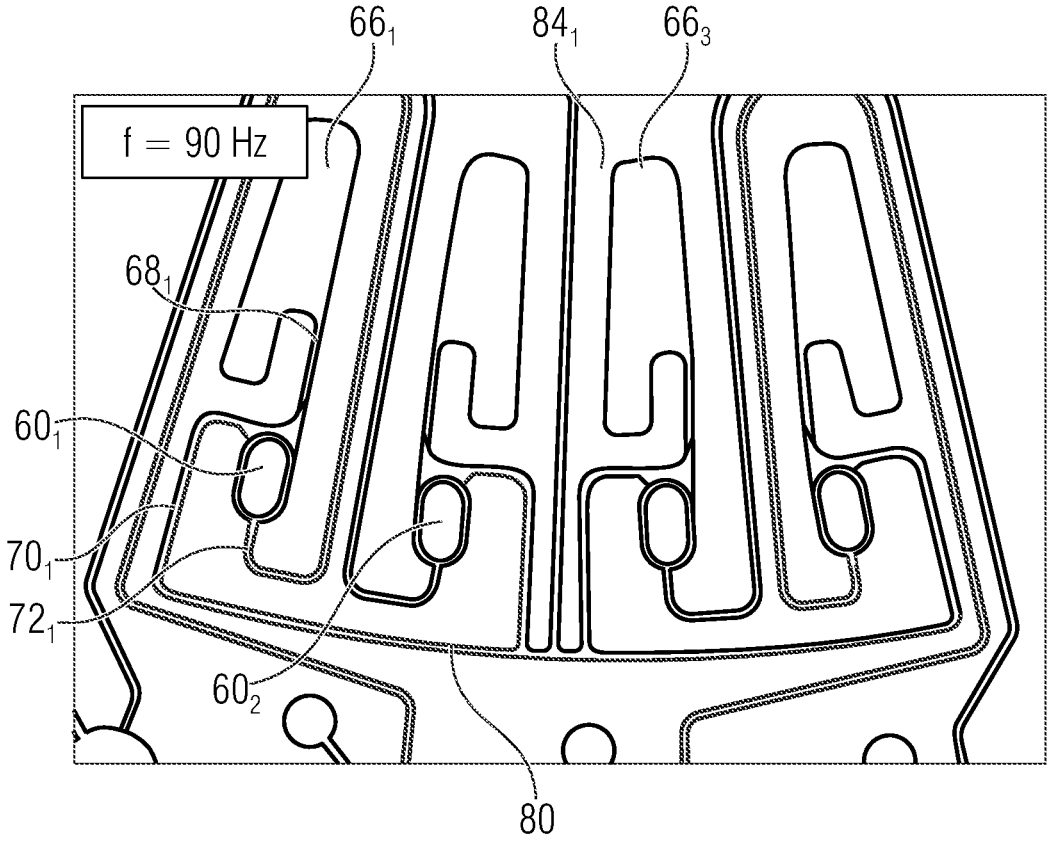
FIG. 6*a* shows a schematic top view of a partial detail of the fluidic module shown in FIG. 5 and a liquid level within the fluidic module at a first point in time.

FIG. 6*a* shows a schematic top view of a partial detail of the fluidic module 50 and a liquid level within the fluidic module 50 at a first point in time. At the first point in time, the fluidic module 50 is subjected to a first rotational frequency $f_1$ (e.g., $f_1$=90 Hz).

Figure 6B:
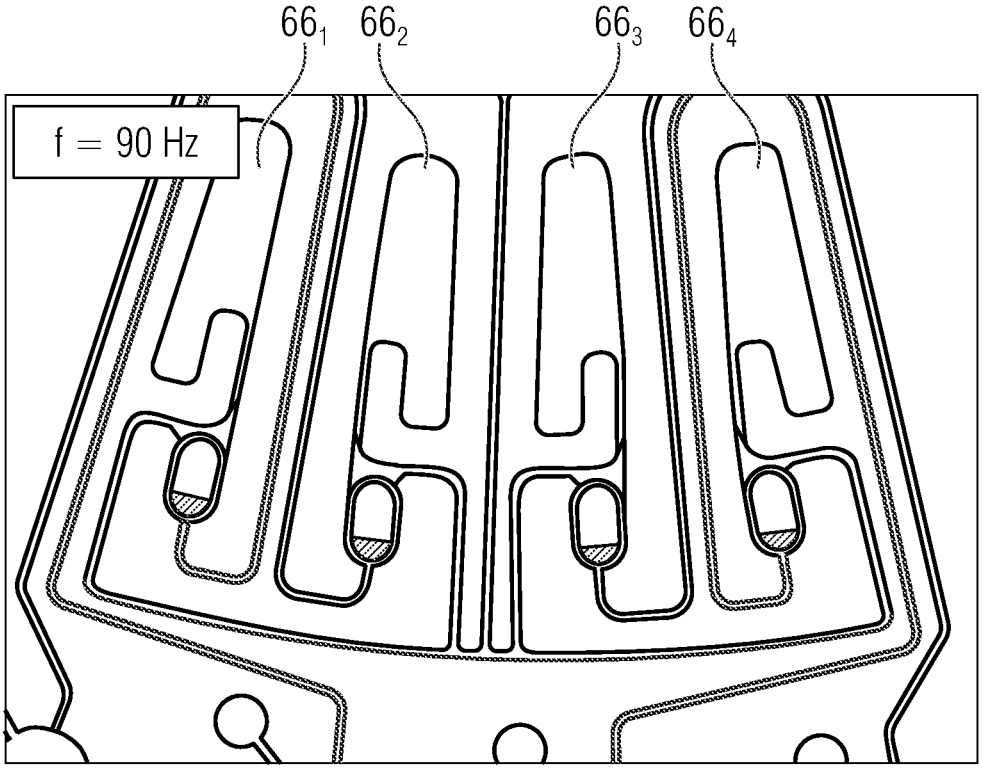
FIG. 6*b* shows a schematic top view of a partial detail of the fluidic module shown in FIG. 5 and a liquid level within the fluidic module at a second point in time.

FIG. 6*b* shows a schematic top view of the partial detail of the fluidic module 50 and a liquid level within the fluidic module 50 at a second point in time. At the second point in time, the fluidic module 50 continues to be subjected to the first rotational frequency $f_1$, whereby the liquid is centrifugally driven into the measuring chambers $\mathbf{60}_1$ to $\mathbf{60}_4$ via the fluid inlet channels $\mathbf{70}_1$ to $\mathbf{70}_4$, which results in the liquid level shown in FIG. 4*b*.

Figure 6C:
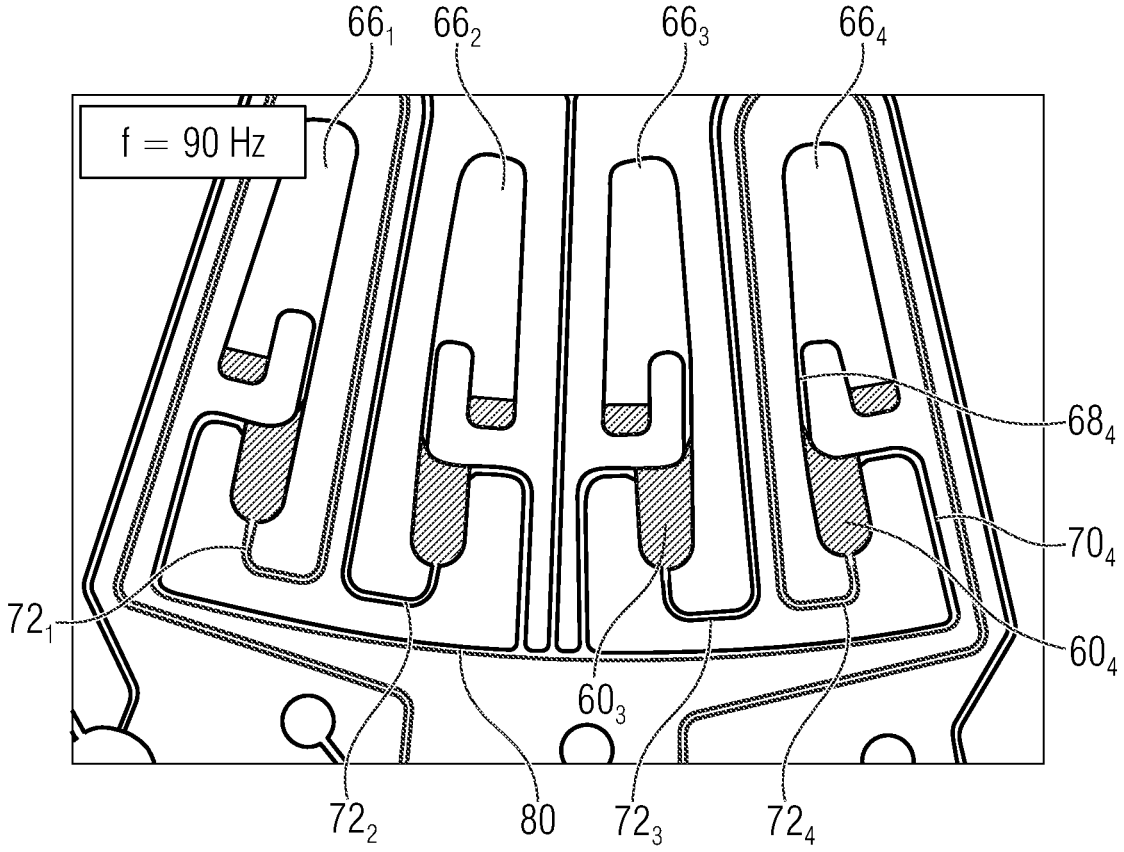
FIG. 6*c* shows a schematic top view of a partial detail of the fluidic module shown in FIG. 5 and a liquid level within the fluidic module at a third point in time.

FIG. 6*c* shows a schematic top view of the partial detail of the fluidic module 50 and a liquid level within the fluidic module 50 at a third point in time. At the third point in time, the liquid module 50 continues to be subjected to the first rotational frequency $f_1$, whereby the liquid continues to be centrifugally driven into the measuring chambers $\mathbf{60}_1$ to $\mathbf{60}_4$ via the fluid inlet channels $\mathbf{70}_1$ to $\mathbf{70}_4$, so that by the third point in time, liquid has already got into the compression chambers $\mathbf{66}_1$ to $\mathbf{66}_4$ from the measuring chambers $\mathbf{60}_1$ to $\mathbf{60}_4$ via the fluid overflows $\mathbf{68}_1$ to $\mathbf{68}_4$.

Figure 6D:
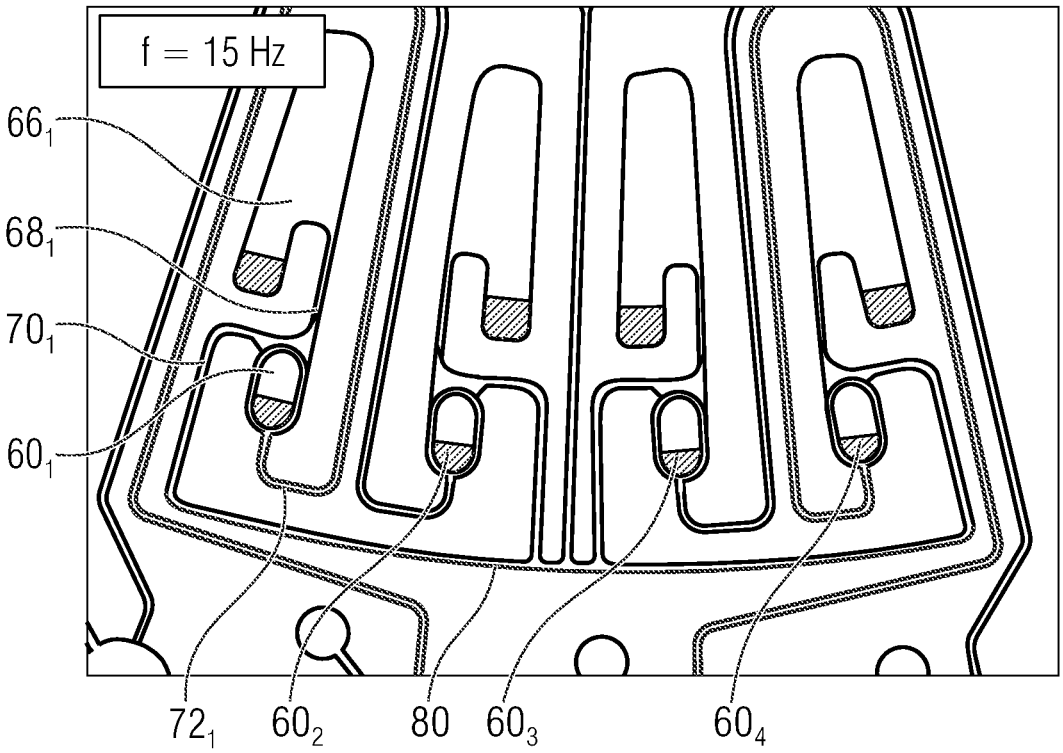
FIG. 6*d* shows a schematic top view of a partial detail of the fluidic module shown in FIG. 5 and a liquid level within the fluidic module at a fourth point in time.

FIG. 6*d* shows a schematic top view of the partial detail of the fluidic module 50 and a liquid level within the fluidic module 50 at a fourth point in time. Between the third and fourth points in time, the rotational frequency to which the fluidic module 50 is subjected has been reduced from the first rotational frequency $f_1$ (e.g., $f_1$=90 Hz) to the second rotational frequency $f_2$ (e.g., $f_2$=15 Hz), which leads to an expansion of the compressible medium, whereby the liquid present within the measuring chambers $\mathbf{60}_1$ to $\mathbf{60}_4$ is driven out of the measuring chambers $\mathbf{60}_1$ to $\mathbf{60}_4$ via the fluid outlet channels $\mathbf{72}_1$ to $\mathbf{72}_4$, while the liquid that previously got into the compression chambers $\mathbf{66}_1$ to $\mathbf{66}_4$ remains within the compression chambers $\mathbf{66}_1$ to $\mathbf{66}_4$.

Figure 6E:
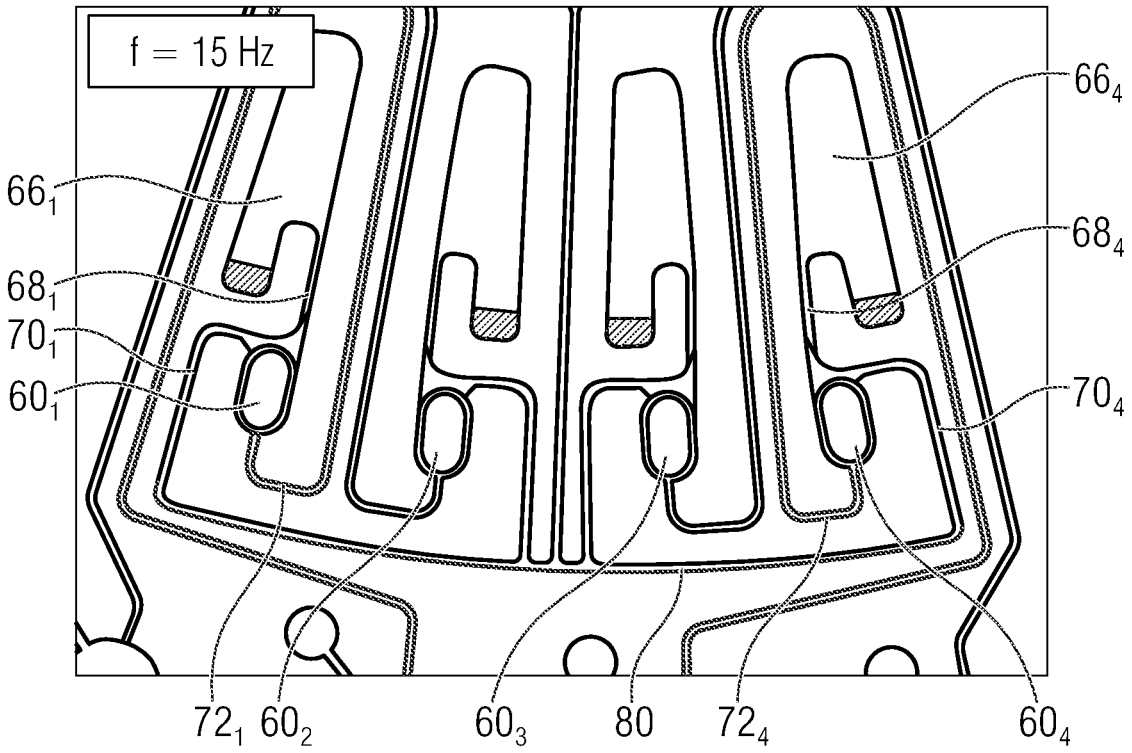
FIG. 6*e* shows a schematic top view of a partial detail of the fluidic module shown in FIG. 5 and a liquid level within the fluidic module at a fifth point in time.

FIG. 6*e* shows a schematic top view of the partial detail of the fluidic module 50 and a liquid level within the fluidic module 50 at a fifth point in time. At the fifth point in time, the fluidic module 50 continues to be subjected to the second rotational frequency $f_2$, whereby the compressible medium has expanded to such an extent that the liquid present within the measuring chambers $\mathbf{60}_1$ to $\mathbf{60}_n$ (n=2) has been (almost) completely driven out of the measuring chambers $\mathbf{60}_1$ to $\mathbf{60}_4$ via the fluid outlet channels $\mathbf{72}_1$ to $\mathbf{72}_4$.

In other words, FIGS. 6*a* to 6*d* show an exemplary course of the aliquoting process. Under a high rotational frequency (centrifugation) of, e.g., 90 Hz, a first liquid flows, via a manifold $\mathbf{80}_1$, from an inlet area $\mathbf{84}_1$ into four measuring chambers $\mathbf{60}_1$ to $\mathbf{60}_4$ having a volume of about 5 μl through a channel $\mathbf{82}_1$ leading radially outward.

The fluid inlet channel $\mathbf{70}_1$ to $\mathbf{70}_4$ leading to the measuring chamber $\mathbf{60}_1$ to $\mathbf{60}_4$ may be configured to start at the top end of the measuring chamber $\mathbf{60}_1$ to $\mathbf{60}_4$ (not mandatory). The fluid outlet channel $\mathbf{72}_1$ to $\mathbf{72}_4$ is then hermetically sealed by a first portion of the inflowing liquid. Thus, further inflowing liquid will then (at least partly) compress the entrapped compressible medium (e.g., gas volume) within the compression chamber (pressure chamber) $\mathbf{66}_1$ to $\mathbf{66}_4$ (see FIG. 6*b*).

The liquid keeps on flowing until the inlet area $\mathbf{84}_1$ has been emptied completely. Each of the measuring chambers $\mathbf{60}_1$ to $\mathbf{60}_4$ has a compression chamber (pressure chamber) $\mathbf{66}_1$ to $\mathbf{66}_4$ connected to it wherein a defined volume of the compressible medium (e.g., air volume) is entrapped. Excess liquid keeps flowing into the drain areas of the individual compression chambers (pressure chambers) $\mathbf{66}_1$ to $\mathbf{66}_4$ until the inlet area $\mathbf{84}_1$ has been emptied (not mandatory). Now a balance between the centrifugal force and the pneumatic counter-pressure is achieved.

If the rotary frequency is reduced, the entrapped compressible medium (e.g., air volume) within the compression chamber (pressure chamber 206) will expand under the lower centrifugal pressure. As a result, the liquid column within the radially extending channel $\mathbf{82}_1$ and within the fluid outflow channel $\mathbf{72}_1$ to $\mathbf{72}_4$, which may be configured as a siphon, for example, increases in turn. From a specific fill height, the filling level exceeds the crest of the siphon $\mathbf{72}_1$ to $\mathbf{72}_4$, and the liquid is transported on. Due to the centrifugal force and excess pressure, the liquid is now completely transferred from the measuring chambers $\mathbf{60}_1$ to $\mathbf{60}_4$ into the chambers $\mathbf{86}_1$ to $\mathbf{86}_4$.

Due to the fact that the fluid inlet channel (filling channel) $\mathbf{70}_1$ to $\mathbf{70}_4$ starts at the top end of the measuring chamber $\mathbf{60}_1$ to $\mathbf{60}_4$, the liquid remains within the fluid inlet channels $\mathbf{70}_1$ to $\mathbf{70}_4$ and is not distributed to the measuring chambers $\mathbf{60}_1$ to $\mathbf{60}_4$.

The accuracy of the aliquoting process will be particularly high when the fluid inlet channels $\mathbf{70}_1$ to $\mathbf{70}_4$ and the fluid outlet channels $\mathbf{72}_1$ to $\mathbf{72}_4$ are small as compared to the measuring chamber $\mathbf{60}_1$ to $\mathbf{60}_4$. Inaccuracies in measurement arise, e.g., due to the fact that different starting conditions such as the input volume, manufacturing tolerances, etc., result in differences in the filling levels during the metering step. As a result, the metering accuracy is directly correlated to the dimensions of the fluid inlet channels $\mathbf{70}_1$ to $\mathbf{70}_4$ and of the fluid outlet channels $\mathbf{72}_1$ to $\mathbf{72}_4$. In this context, smaller dimensions will result in more accurate metering.

Further measuring errors arise during emptying of the measuring chambers (measuring cavities) $\mathbf{60}_1$ to $\mathbf{60}_4$. Since there may be a difference in pressure between the measuring chambers $\mathbf{60}_1$ to $\mathbf{60}_4$, there may be an exchange of liquid between the measuring chambers $\mathbf{60}_1$ to $\mathbf{60}_4$. To minimize this, it is possible, on the one hand, for the fluid outlet channel (e.g., siphon) $\mathbf{72}_1$ to $\mathbf{72}_4$ to have a fluidic resistance much smaller than the sum of resistances of the fluid inlet channels $\mathbf{70}_1$ to $\mathbf{70}_4$, and it is possible, on the other hand, for the fluid inlet channel (filling channel) $\mathbf{70}_1$ to $\mathbf{70}_4$ to start at a radially inward point of the measuring chamber $\mathbf{60}_1$ to $\mathbf{60}_4$. As a result, the measuring chambers $\mathbf{60}_1$ to $\mathbf{60}_4$ are not in fluidic communication at least during a certain emptying period. During this time, thus, potential pressure differences will not cause any additional errors.

The above-described aliquoting concepts (radially inward aliquoting) may also be used for aliquoting liquids from radially outward to radially further inward by making small changes (radially outward aliquoting). In this context, the siphon $\mathbf{72}_1$ to $\mathbf{72}_4$ may be replaced by a fluid outlet channel $\mathbf{72}_5$ to $\mathbf{72}_8$ leading inward (see FIG. 5). The input volume of the liquid per measuring chamber (aliquoting chamber) $\mathbf{60}_1$ to $\mathbf{60}_4$ may be configured such that (virtually) all of the liquid present within the measuring chamber $\mathbf{60}_1$ to $\mathbf{60}_4$ and all of the liquid present within the fluid outlet channel $\mathbf{72}_5$ to $\mathbf{72}_8$ is transferred into a subsequent chamber $\mathbf{86}_1$ to $\mathbf{86}_4$ located further inward.

By combining the two above-described aliquoting concepts (radially inward aliquoting and radially outward aliquoting), an aliquoting concept may be devised which aliquots two liquids on one fluidic layer. The overall structure may then be configured, e.g., such that an aliquot from a first aliquoting structure (first half of the measuring chambers $\mathbf{60}_1$ to $\mathbf{60}_4$) and an aliquot from a second aliquoting structure (second half of measuring chambers $\mathbf{60}_5$ to $\mathbf{60}_8$), respectively are transferred into a shared chamber (cavity) $86_1$ to $86_4$. The subsequent chamber (cavity) $86_1$ to $86_4$ may be a mixing chamber $86_1$ to $86_4$. The entire circumference around the axis of rotation may potentially be used for fluidic structures.

The aliquoting concept presented herein generally is also suited for aliquoting on a disc structured in a multi-layered manner. The disc may be configured such that the liquid for filling may be guided over a fluidic layer A and in the process may potentially be directed past crossing channels. The chamber is now emptied via a channel on the fluidic layer B. This channel may be both a siphon (e.g., $72_1$ to $72_4$) and a different channel leading radially inward, for example (e.g., $72_5$ to $72_8$). Other than that, the aliquoting process takes place as was described with regard to radially inward aliquoting. This is the obvious process to be performed, e.g., when the number of aliquots for the radially inward liquid is high (>10) and, as a result, the adjacently arranged siphon structures ($72_1$ to $72_4$) can no longer be introduced in a spatially efficient manner. Moreover, such a configuration is advantageous as soon as more than two liquids are aliquoted into one chamber (cavity) $86_1$ to $86_4$. The fluidic connection may be realized either within the measuring chamber $60_1$ to $60_8$ itself or within a fluidic opening specifically provided for this purpose. It is possible to either provide each measuring chamber $60_1$ to $60_8$ with a fluidic opening of its own or for several measuring chambers $60_1$ to $60_8$ to share one fluidic opening.

Embodiments of the present invention enable simultaneous, parallel aliquoting of two liquids on a fluidic layer. Measuring, or metering, of the volumes takes place at high pressures, whereby capillary forces have little influence. Moreover, embodiments enable a potentially high level of accuracy since metering of the liquids takes place at high rotational frequencies. In addition, embodiments can dispense with sharp edges.

Unlike known aliquoting methods, the metering step of embodiments is performed at "high" rotational frequencies (rotary frequencies) and is subsequently switched to low rotational frequencies (rotary frequencies). Unlike known fluidic structures, the fluidic structure described herein is still functional even in the event of heavy overfilling (>50% of the volume measured). Unlike known aliquoting concepts, the aliquoting concept described herein enables aliquoting and connecting two liquids on one fluidic layer. Unlike known fluidic structures, in the fluidic structure described herein, the liquid may be supplied to the measuring chambers from outside and, additionally, the liquid may subsequently be processed further. Unlike known fluidic structures, at least two aliquots may have a waste cavity connected (directly or via a channel) to said metering chamber, which may be exploited, e.g., for performing individual quality control on each single aliquot by reading out the filling level within the waste cavity. Unlike known fluidic structures, in the fluidic structure described herein, the measuring chambers are separated from one another by a fluidic resistance higher than that of the channel used for forwarding the aliquots.

Further embodiments provide a fluidic structure comprising a fluid inlet channel (fluid inlet) having a high fluidic resistance, a fluid outlet channel (fluid outlet) having a low fluidic resistance, a measuring chamber and a compression chamber (pressure chamber), which are separated by a fluid overflow (fluid channel). The fluidic structure is configured such that upon filling of the fluidic structure, a compressible medium (e.g., air volume) is entrapped and that the volume of liquid introduced is larger than that encompassed by the volume of the measuring chamber, whereby excess liquid flows into the compression chamber (pressure chamber) through the fluid overflow and remains there; upon reduction of the rotational frequency (rotary frequency), a defined amount of liquid now directed through the fluid outlet channel (outlet).

Further embodiments provide a fluidic structure and a method of aliquoting several aliquots, the metering step being performed at "high" rotational frequencies (rotary frequencies), and forwarding of the liquids taking place at low rotary frequencies. The fluidic structure may be configured such that upon filling of the measuring chamber, a compressible medium (e.g., air) is compressed within the compression chamber. Moreover, the fluidic structure may be configured such that the fluid inlet of the measuring chamber comprises a fluidic resistance higher than that of the fluid outlet of the measuring chamber. Furthermore, the fluidic structure may be configured such that at least two aliquots comprise a waste cavity connected (directly or via a channel) to said measuring chamber. In addition, the fluidic structure may be configured such that during the volume-determining metering step, the meniscus is present only in such channels which are small as compared to the measuring chamber. Moreover, the fluidic structure may be configured such that the volume-determining measuring chamber is filled to a level of more than 50% (70%, 90%, completely). Furthermore, the fluidic structure may be configured such that during emptying, an interface between the compressible medium and the liquid (e.g., air/water interface) is displaced radially inward. Moreover, the fluidic structure may be configured such that at least one measuring chamber is filled from a radially further inward direction and is emptied in a radially further outward direction.

Figure 7:
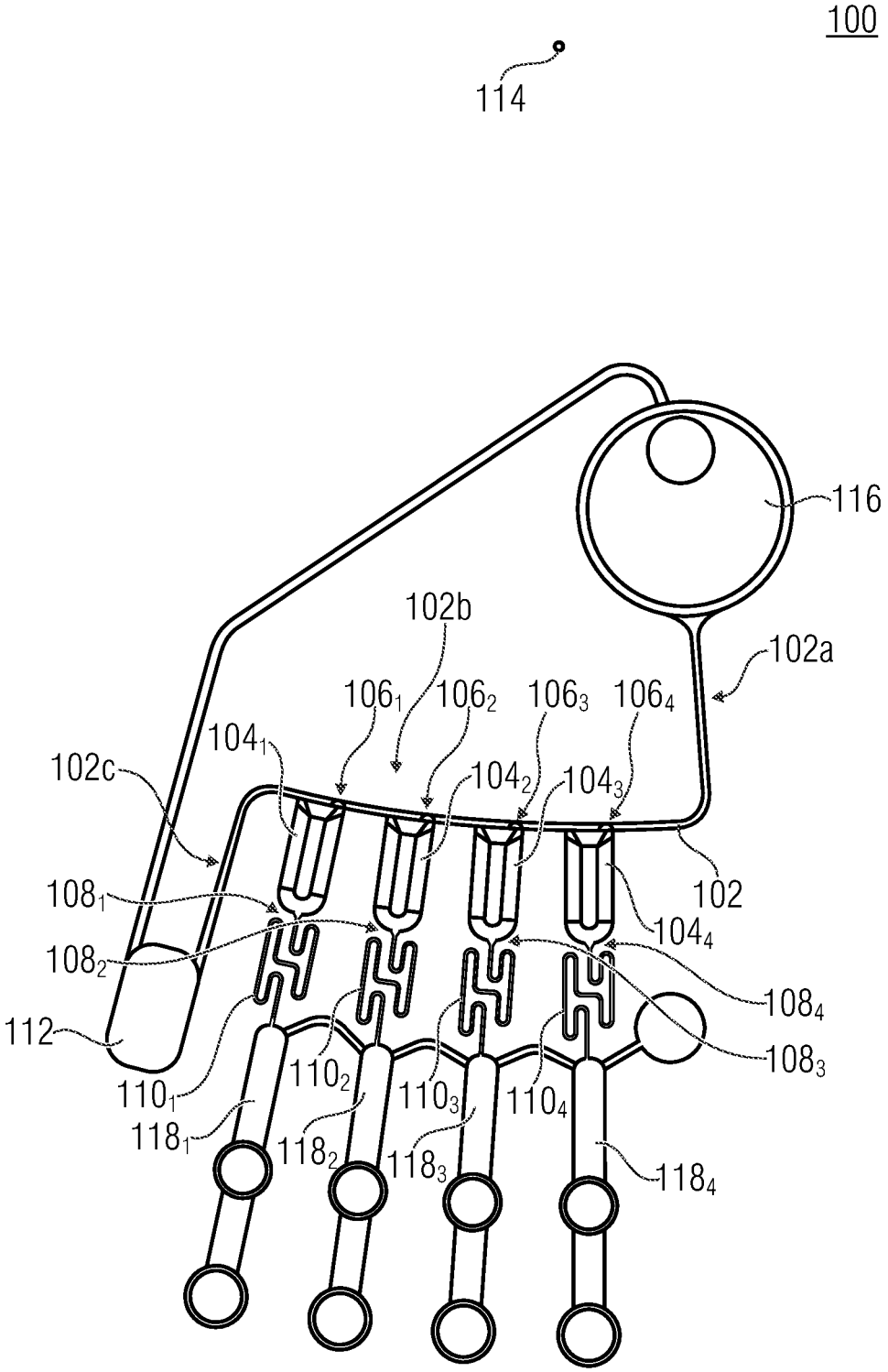
FIG. 7 shows a schematic top view of a detail of a fluidic module.

FIG. 7 shows a schematic top view of a detail of a fluidic module 100. The fluidic module 100 includes a fluid inlet channel 102, at least one measuring chamber $104_1$ to $104_i$ comprising a fluid inlet $106_1$ to $106_i$ and a fluid outlet $108_1$ to $108_i$, at least one fluid resistance element $110_1$ to $110_i$ and an overflow 112, the fluid inlet channel 102 being connected to the at least one measuring chamber $104_1$ to $104_i$ via the fluid inlet $106_1$ to $106_i$ and to the overflow 112, and the at least one fluid resistance element $110_1$ to $110_i$ being connected to the at least one measuring chamber $104_1$ to $104_i$ via the fluid outlet $108_1$ to $108_i$. The fluidic module 100 is configured such that upon rotation of the fluidic module about a center of rotation 114 and upon a centrifugal pressure resulting therefrom, a liquid is centrifugally driven into the at least one measuring chamber $104_1$ to $104_i$ via the fluid inlet channel 102, the at least one fluid resistance element $110_1$ to $110_i$ comprising a fluidic resistance higher than a fluidic resistance of the fluid inlet channel 102 and than a fluidic resistance of the fluid inlet $104_1$ to $104_i$, so that the volume of liquid driven into the at least one measuring chamber $104_1$ to $104_i$ is larger than the volume of liquid that exits the at least one measuring chamber $104_1$ to $104_i$ via the at least one fluid resistance element $110_1$ to $110_i$, so that the at least one measuring chamber $104_1$ to $104_i$ is filled and excess liquid gets into the overflow 112. The fluidic module 100 may further be configured such that upon an increase in the rotational frequency (e.g. by at least a factor of 2 (or 3, 4, 5, 7, 10)) and upon an increase, resulting therefrom, of the centrifugal pressure, the liquid present within the at least one measuring chamber $104_1$ to $104_i$ is driven out of the measuring chamber $104_1$ to $104_i$ via the at least one variable fluid resistance element $110_1$ to $110_i$ faster than was the case prior to the increase in the rotational frequency.

It shall be noted that the rotational frequency need not be increased in order for the liquid present within the at least one measuring chamber $\mathbf{104}_1$ to $\mathbf{104}_i$ to be centrifugally driven out of same. The increase in the rotational frequency results in an increase in the centrifugal pressure, so that the liquid present within the at least one measuring chamber $\mathbf{104}_1$ to $\mathbf{104}_i$ can be driven out of same faster.

Moreover, the fluidic module 100 may comprise an inlet area 116 connected to the fluid inlet channel 102.

A first portion 102*a* of the fluid inlet channel 102 may be connected to the inlet area 116 and may extend from radially further inward to radially further outward. A second portion 102*b* of the fluid inlet channel 102, to which the at least one measuring chamber $\mathbf{104}_1$ to $\mathbf{104}_i$ may be connected, may extend laterally (e.g. have a uniform radial distance from the center of rotation 114). A third portion 102*c* of the fluid inlet channel 102 may extend from radially further inward to radially further outward and may be connected to the overflow 112.

Moreover, the fluidic module 100 may comprise at least one further chamber $\mathbf{118}_1$ to $\mathbf{118}_4$ connected to an output of the at least one variable fluid resistance element $\mathbf{110}_1$ to $\mathbf{110}_i$, the at least one measuring chamber $\mathbf{104}_1$ to $\mathbf{104}_i$ being connected to the at least one variable fluid resistance element $\mathbf{110}_1$ to $\mathbf{110}_i$ via an input of the at least one variable fluid resistance element $\mathbf{110}_1$ to $\mathbf{110}_i$.

In other words, FIG. 7 shows a fluidic structure 100 (metering structure or aliquoting structure) comprising an inlet area 116, a filling and overflow channel 102, a measuring chamber $\mathbf{104}_1$ to $\mathbf{104}_i$, a valve $\mathbf{110}_1$ to $\mathbf{110}_i$ and an overflow 112, the valve $\mathbf{110}_1$ to $\mathbf{110}_i$ not closing completely but having liquid flow through it continuously.

In this context, the flow resistance of the valve $\mathbf{110}_1$ to $\mathbf{110}_i$ is sufficiently high so that at a first rotational frequency f1, the velocity at which the liquid fills the measuring chamber $\mathbf{104}_1$ to $\mathbf{104}_i$ and at which excess liquid drains into the overflow area 112 from the inlet area 116 via the overflow channel 102 is much higher than that at which liquid is forwarded into a subsequent chamber $\mathbf{118}_1$ to $\mathbf{118}_i$ downstream from the valve $\mathbf{110}_1$ to $\mathbf{110}_i$. Typically, the process of dividing the liquid would be at least 10 times (or, better, 100 times) faster than forwarding the liquid. As a result, the volume accuracy of metering is ensured without involving a valve $\mathbf{110}_1$ to $\mathbf{110}_i$ which would completely prevent the flow of liquid during the filling process.

Even though some aspects have been described within the context of a device, it is understood that said aspects also represent a description of the corresponding method, so that a block or a structural component of a device is also to be understood as a corresponding method step or as a feature of a method step. By analogy therewith, aspects that have been described in connection with or as a method step also represent a description of a corresponding block or detail or feature of a corresponding device. Some or all of the method steps may be performed by a hardware device (or while using a hardware device), such as a microprocessor, a programmable computer or an electronic circuit. In some embodiments, some or several of the most important method steps may be performed by such a device.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A fluidic module comprising:

a first measuring chamber and a second measuring chamber;

a first fluid inlet channel connected to the first measuring chamber and a second fluid inlet channel connected to the second measuring chamber;

a first fluid outlet channel connected to the first measuring chamber and a second fluid outlet channel connected to the second measuring chamber;

a first compression chamber and a second compression chamber, the first compression chamber and the first measuring chamber being connected to each other via a first fluid overflow, and the second compression chamber and the second measuring chamber being connected to each other via a second fluid overflow;

the fluidic module comprising a fluid manifold, the first fluid inlet channel and the second fluid inlet channel being connected to the fluid manifold;

wherein, the fluidic module being configured such that upon rotation of the fluidic module, a liquid is centrifugally driven into the first measuring chamber via the first fluid inlet channel and into the second measuring chamber via the second fluid inlet channel so that a compressible medium previously present within the first measuring chamber and within the second measuring chamber is compressed by the liquid driven into the first measuring chamber and into the second measuring chamber;

wherein, the fluidic module being configured such that upon a reduction of the rotational frequency and upon an expansion, resulting therefrom, of the compressible medium, the liquid present within the first measuring chamber is driven out of the first measuring chamber via the first fluid outlet channel, and the liquid present within the second measuring chamber is driven out of the second measuring chamber via the second fluid outlet channel; and wherein, the fluidic module being configured such that upon the rotation of the fluidic module, the liquid is centrifugally driven into the first measuring chamber via the first fluid inlet channel and into the second measuring chamber via the second fluid inlet channel until liquid gets into a portion of the first compression chamber from the first measuring chamber via the first fluid overflow, in which portion it is separate from the liquid present within the first measuring chamber, and gets into a portion of the second compression chamber from the second measuring chamber via the second fluid overflow, in which portion it is separate from the liquid present within the second measuring chamber, and until a compression, caused by the liquid driven into the first measuring chamber, of a compressible medium previously present within the first measuring chamber, within the first compression chamber and within the first fluid overflow and a compression, caused by the liquid driven into the second measuring chamber, of a compressible medium previously present within the second measuring chamber, within the second compression chamber and within the second fluid overflow is sufficiently large so that upon a reduction of a rotational frequency and upon an expansion, resulting therefrom, of the compressible medium, the liquid present within the first measuring chamber is driven out of the first measuring chamber via the first fluid outlet channel, and the liquid present within the second measuring chamber is driven out of the second measuring chamber via the second fluid overflow.

2. The fluidic module as claimed in claim 1, wherein fluidic resistances of the first fluid inlet channel and of the second fluid inlet channel are larger, due to the geometric configuration, than fluidic resistances of the first fluid outlet channel and of the second fluid outlet channel.

3. The fluidic module as claimed in claim 1, wherein a dimension of the first fluid inlet channel and of the second fluid inlet channel is smaller by at least a factor of five than a dimension of the first measuring chamber and of the second measuring chamber, and/or wherein a diameter of the first fluid outlet channel and of the second fluid outlet channel is smaller by at least a factor of five than a diameter or a diagonal of the first measuring chamber and of the second measuring chamber.

4. The fluidic module as claimed in claim 1, wherein the fluidic module being configured such that upon the rotation of the fluidic module, the liquid centrifugally driven into the first measuring chamber encompasses the compressible medium present within the first measuring chamber, within the first compression chamber and within the first fluid overflow, and the liquid centrifugally driven into the second measuring chamber encompasses the compressible medium present within the second measuring chamber, within the second compression chamber and within the second fluid overflow.

5. The fluidic module as claimed in claim 1, wherein the fluidic module being configured such that upon the rotation of the fluidic module, the amount of liquid centrifugally driven into the first measuring chamber and into the second measuring chamber is larger than that which can be accommodated by the first measuring chamber and the second measuring chamber, so that liquid gets into the first compression chamber from the first measuring chamber via the first fluid overflow and gets into the second compression chamber from the second measuring chamber via the second fluid overflow.

6. The fluidic module as claimed in claim 1, wherein the fluidic module being configured such that upon the reduction of the rotational frequency and upon the expansion, resulting therefrom, of the compressible medium, the liquid present within the first measuring chamber is driven out of the first measuring chamber via the first fluid outlet channel and the liquid present within the second measuring chamber is driven out of the second measuring chamber via the second fluid outlet channel for such time until at least part of an excess volume fraction of the compressible medium exits the first measuring chamber via the first fluid outlet channel and exits the second measuring chamber via the second fluid outlet channel.

7. The fluidic module as claimed in claim 1, wherein the fluidic module being configured such that upon the reduction of the rotational frequency, the liquid that has got into the first compression chamber remains within the first compression chamber and the liquid that has got into the second compression chamber remains within the second compression chamber.

8. The fluidic module as claimed in claim 7, wherein the fluidic module being configured such that upon the reduction of the rotational frequency, the liquid that has got into the first compression chamber remains within the first compression chamber and the liquid that has got into the second compression chamber remains within the second compression chamber, so that upon the reduction of the rotational frequency and upon the expansion, resulting therefrom, of the compressible medium, the liquid present within the first measuring chamber is driven out of the first measuring chamber via the first fluid outlet channel and the liquid present within the second measuring chamber is driven out of the second measuring chamber via the second fluid outlet channel for such time until at least part of an excess volume fraction of the compressible medium exits the first measuring chamber via the first fluid outlet channel and exits the second measuring chamber via the second fluid outlet channel.

9. The fluidic module as claimed in claim 7, wherein the first and second fluid inlet channels and the first and second fluid outlet channels are configured such that upon the expansion of the compressible medium, an excess volume fraction, which results from the liquid remaining within the first and second compression chambers, of the compressible medium exits the first measuring chamber via the first fluid outlet channel and exits the second measuring chamber via the second fluid outlet channel in an amount of at least 70%.

10. The fluidic module as claimed in claim 7, wherein the fluidic module being configured such that upon the reduction of the rotational frequency, the liquid that has got into the first compression chamber remains within the first compression chamber and the liquid that has got into the second compression chamber remains within the second compression chamber, so that upon the reduction of the rotational frequency and upon the expansion, resulting therefrom, of the compressible medium, the liquid present within the first measuring chamber is driven, via the first fluid outlet channel, into a first chamber connected to the first fluid outlet channel, and the liquid present within the second measuring chamber is driven, via the second fluid outlet channel, into a second chamber connected to the second fluid outlet channel.

11. The fluidic module as claimed in claim 1, wherein the first measuring chamber and the second measuring chamber are configured to each meter a volume of the liquid.

12. The fluidic module as claimed in claim 1, wherein the first measuring chamber and the second measuring chamber are configured to each meter a volume of the liquid, wherein the first fluid overflow defines the volume metered by the first measuring chamber and the second fluid overflow defines the volume metered by the second measuring chamber.

13. The fluidic module as claimed in claim 1, wherein the first measuring chamber comprises a first fluid inlet and a first fluid outlet, and the second measuring chamber comprises a second fluid inlet and a second fluid outlet, the first fluid inlet and the second fluid inlet being arranged radially further inward than are the first fluid outlet and the second fluid outlet, the first fluid inlet channel being connected to the first measuring chamber via the first fluid inlet, the second fluid inlet channel being connected to the second measuring chamber via the second fluid inlet, the first fluid outlet channel being connected to the first measuring chamber via the first fluid outlet, and the second fluid outlet channel being connected to the second measuring chamber via the second fluid outlet.

14. The fluidic module as claimed in claim 13, wherein the first fluid outlet is radially arranged at an outer end of the first measuring chamber and the second fluid outlet is radially arranged at an outer end of the second measuring chamber, and/or wherein the first fluid inlet is radially arranged at an inner end of the first measuring chamber and the second fluid inlet is radially arranged at an inner end of the second measuring chamber.

15. The fluidic module as claimed in claim 1, wherein the first measuring chamber comprises a combined fluid inlet/fluid outlet and the second measuring chamber comprises a second combined fluid inlet/fluid outlet, the first fluid inlet channel and the first fluid outlet channel being connected to the first measuring chamber via the first combined fluid inlet/fluid outlet, and the second fluid inlet channel and the second fluid outlet channel being connected to the second measuring chamber via the second combined fluid inlet/fluid outlet; in the first and second combined fluid inlets/fluid outlets, the respective fluid outlet channel opens into the respective fluid inlet channel.

16. The fluidic module as claimed in claim 1, wherein the first fluid outlet channel and the second fluid outlet channel each comprise a siphon.

17. The fluidic module as claimed in claim 1, wherein fluidic resistances of the first fluid outlet channel and of the second fluid outlet channel each are smaller than a sum of the fluidic resistances of the first fluid inlet channel and the second fluid inlet channel.

18. The fluidic module as claimed in claim 1, wherein the first fluid inlet channel and the second fluid inlet channel each comprise a fluidic resistance higher than that of the fluid manifold.

19. The fluidic module as claimed in claim 18, wherein the fluidic module comprising a fluid inlet connected to the fluid manifold via a fluid channel, the fluid channel comprising a fluidic resistance higher than that of the fluid manifold.

20. The fluidic module as claimed in claim 1, wherein the fluidic module being configured such that upon the rotation of the fluidic module, a first liquid is driven into the first measuring chamber and a second liquid is driven into the second measuring chamber, the first fluid outlet channel and the second fluid outlet channel being connected to a mixing chamber.

21. The fluidic module as claimed in claim 20, wherein the first measuring chamber and the first compression chamber are arranged radially further inward than are the second measuring chamber and the second compression chamber.

22. A device for aliquoting a liquid, comprising:

a fluidic module comprising:

a first measuring chamber and a second measuring chamber;

a first fluid inlet channel connected to the first measuring chamber and a second fluid inlet channel connected to the second measuring chamber; and a first fluid outlet channel connected to the first measuring chamber and a second fluid outlet channel connected to the second measuring chamber;

the fluidic module being configured such that upon rotation of the fluidic module, a liquid is centrifugally driven into the first measuring chamber via the first fluid inlet channel and into the second measuring chamber via the second fluid inlet channel so that a compressible medium previously present within the first measuring chamber and within the second measuring chamber is compressed by the liquid driven into the first measuring chamber and into the second measuring chamber;

the fluidic module being configured such that upon a reduction of the rotational frequency and upon an expansion, resulting therefrom, of the compressible medium, the liquid present within the first measuring chamber is driven out of the first measuring chamber via the first fluid outlet channel, and the liquid present within the second measuring chamber is driven out of the second measuring chamber via the second fluid outlet channel;

the fluidic module comprising a fluid manifold, the first fluid inlet channel and the second fluid inlet channel being connected to the fluid manifold;

and a drive;

the drive comprising a processor programmed to subject, in a first phase, the fluidic module to such a rotational frequency that liquid is centrifugally driven into the first measuring chamber via the first fluid inlet channel and into the second measuring chamber via the second fluid inlet channel, so that a compressible medium previously present within the first measuring chamber and within the second measuring chamber is compressed by the liquid driven into the first measuring chamber and into the second measuring chamber; and the processor further programmed to reduce, in a second phase, the rotational frequency to which the fluidic module is subjected to such an extent that due to the reduction of the rotational frequency and to the expansion, resulting therefrom, of the compressible medium, the liquid present within the first measuring chamber is driven out of the first measuring chamber via the first fluid outlet channel, and the liquid present within the second measuring chamber is driven out of the second measuring chamber via the second fluid outlet channel.

* * * * *